US008713961B2

(12) United States Patent
Shimaoka et al.

(10) Patent No.: US 8,713,961 B2
(45) Date of Patent: May 6, 2014

(54) OUTDOOR UNIT

(75) Inventors: Kazuhiro Shimaoka, Ota (JP); Kenichi Nakajima, Ora-gun (JP); Jun Yamauchi, Kumagaya (JP); Shintaro Sugimoto, Ota (JP); Yoshimi Kusama, Ota (JP); Yoshiaki Kaneko, Sano (JP)

(73) Assignee: Sanyo Electric Co., Ltd., Osaka (JP)

( * ) Notice: Subject to any disclaimer, the term of this patent is extended or adjusted under 35 U.S.C. 154(b) by 1024 days.

(21) Appl. No.: 12/781,421

(22) Filed: May 17, 2010

(65) Prior Publication Data

US 2010/0294466 A1 Nov. 25, 2010

(30) Foreign Application Priority Data

May 20, 2009 (JP) ..... 2009-121951
Jun. 23, 2009 (JP) ..... 2009-148816

(51) Int. Cl.
*F25D 19/00* (2006.01)

(52) U.S. Cl.
USPC ..... 62/455

(58) Field of Classification Search
USPC ..... 62/259.2, 506, 507, 259.1, 515, 104.33, 62/324.5; 361/688–691, 694–679, 361/701–703
See application file for complete search history.

(56) References Cited

U.S. PATENT DOCUMENTS 4,570,814 A * 2/1986 Seeley ..... 220/4.28

FOREIGN PATENT DOCUMENTS

| | | | |
|---|---|---|---|
| JP | 09-049647 A | | 2/1997 |
| JP | 10122601 A | * | 5/1998 |
| JP | 2005-127691 | | 5/2005 |
| JP | 2009-030884 | | 2/2009 |
| JP | 2009-030885 A | | 2/2009 |
| JP | 2009293807 A | * | 12/2009 |

OTHER PUBLICATIONS

Japanese Office Action issued in Application No. 2009-121951 dated Apr. 23, 2013.

* cited by examiner

*Primary Examiner* — Cheryl J Tyler
*Assistant Examiner* — Ana Vazquez
(74) *Attorney, Agent, or Firm* — McDermott Will & Emery LLP

(57) ABSTRACT

In an outdoor unit having a housing containing a heat exchange chamber and a machine chamber vertically partitioned by a partition plate, an electrical component box includes a main body portion disposed in the machine chamber and having a first electrical component unit, and a protrusion portion protruding from the machine chamber into the heat exchange chamber and having a second electrical component unit. The main body portion and the protrusion portion are joined to form an air flowing path for sucking cooling air from the back surface side of the machine chamber, branching the cooling air into first cooling air directly flowing to the sink tank and second cooling air passing over electrical parts of the first electrical component unit and then converging with the first cooling air at the entrance of the sink tank.

5 Claims, 13 Drawing Sheets

OUTDOOR UNIT

INCORPORATION BY REFERENCE

The present application claims priority under 35 U.S.C. §119 to Japanese Patent Application No. 2009-121951 filed on May 20, 2009 and Japanese Patent Application No. 2009-148816 filed on Jun. 23, 2009. The content of the applications is incorporated herein by reference in its entirety.

BACKGROUND OF THE INVENTION

1. Field of the Invention

The present invention relates to an outdoor unit having a housing that is vertically partitioned into a heat exchange chamber and a machine chamber through a partition plate, a heat exchanger and an air blower being mounted in the heat exchange chamber while a compressor and an electrical component box are mounted in the machine chamber.

2. Description of Related Art

In general, there is known an outdoor unit of an air conditioner in which a housing of the outdoor unit is vertically partitioned into a heat exchange chamber and a machine chamber through a partition plate, a heat exchanger and an air blower being mounted in the heat exchange chamber while a compressor and an electrical component box are mounted in the machine chamber.

For example, according to this type of outdoor unit proposed in JP-A-2009-30884, an electrical component box of the outdoor unit is designed so that a part thereof overhangs from the machine chamber to the heat exchanger chamber, and a heat sink of an electrical component unit is disposed at this overhang site. Outdoor air which is introduced from the back side of the machine chamber into the machine chamber by negative pressure of the air blower is introduced to the heat sink of the electrical component unit to cool the heat sink, and then the out air concerned is blown out to the heat exchanger.

A maintenance work is executed on this type of electrical component box while a front panel of the outdoor unit is detached. Therefore, for example when the electrical component box is equipped with a plate member which extends substantially straightly in the width direction of the machine chamber and an electrical component unit different from the electrical component unit described above is disposed on the front surface of the plate member, various kinds of works on the electrical component unit concerned can be easily performed from the front surface side. However, in this case, cooling air introduced from the back side of the machine chamber into the machine chamber hardly passes through the front surface side of the plate member, and thus there occurs such a situation that the electrical component unit disposed on the front surface of the plate member is not sufficiently cooled.

Furthermore, JP-A-2005-127691 discloses an outdoor unit in which an electrical component unit for supporting an electrical component board substantially in horizontal position is disposed at the upper portion of the partition plate for partitioning the housing into compartmented heat exchange chamber and machine chamber. In this type of outdoor unit, the electrical component unit comprises an electrical component case constructed by integrating a box-shaped box portion at the lower side and a planar board mount portion at the upper side, and a lid member for covering the electrical component board supported in the electrical component case, and the electrical component case is designed in a frame shape having a large opening, thereby enhancing ventilation, reducing materials, etc.

However, in the related arts, the strength of the electrical component case is lowered because of the electrical component case is designed in a frame shape, and thus when a load is applied from the outside through a top plate of the outdoor unit on the electrical component case below the top plate, the electrical case may be deformed, so that stress is applied to the electrical component board.

SUMMARY OF THE INVENTION

The present invention has been implemented to solve the above problem of the related arts and has an object to provide an outdoor unit that can sufficiently cool an electrical component unit in an electrical component box.

The present invention has another object to provide an outdoor unit having an electrical component unit that is designed in a frame shape and suppresses a situation that stress is imposed on an electrical component board by an external load or external force.

In order to attain the above object, according to an aspect of the present invention, there is provided an outdoor unit having a housing that is vertically partitioned into a heat exchange chamber and a machine chamber by a partition plate, a heat exchanger and an air blower being mounted in the heat exchanger chamber and a compressor and an electrical component box being mounted in the machine chamber, wherein the electrical component box comprises a main body portion that is disposed in the machine chamber and has a first electrical component unit containing electrical parts at the front surface side of the machine chamber and a protrusion portion that protrudes from the machine chamber into the heat exchange chamber and has a second electrical component unit containing a heat sink, and the main body portion and the protrusion portion are joined to each other so as to form an air flowing path for sucking cooling air from the back surface side of the machine chamber, branching the cooling air into first cooling air and second cooling air so that the second cooing air directly flows to an entrance of the sink tank of the second electrical component unit to cool the sink tank and the first cooling air passes over the electrical parts of the first electrical component unit to cool the electrical parts and then converges with the first cooling air at the entrance of the sink tank, and then discharging the first cooling air and the second cooling air to a negative pressure side of the air blower in the heat exchange chamber.

According to the above outdoor unit, the cooling air from the back surface of the machine chamber is branched, and the branched first cooling air is supplied to the front surface side of the first electrical component unit. Therefore, the electrical parts on the front surface of the first electrical component unit can be sufficiently cooled. Furthermore, the first cooling air cools the electrical parts of the first electrical component unit and then converges with the second cooling air for cooling the heat sink of the second electrical component unit. Therefore, a sufficient air amount of cooling air flows through the heat sink of the second electrical component unit, and thus the heat sink can be sufficiently cooled. Still furthermore, the converging cooling air cools the heat sink, and then flows to the negative pressure side of the air blower in the heat exchange chamber. Therefore, the cooling air can be made to smoothly flow into the heat exchange chamber, and also sufficient cooling air can be made to flow into the machine chamber and the electrical component box.

In the above construction, the electrical component box may have a branch plate for branching the cooling air sucked from the back surface side of the machine chamber into the first cooling air and the second cooling air.

According to this construction, the cooling air from the back surface of the machine chamber can be easily branched into the first cooling air and the second cooling air and the electrical component unit in the electrical component box can be sufficiently cooled with a simple construction that the branch plate is provided.

In the above construction, the main body portion may have a first electrical component unit support plate that extends in a width direction of the machine chamber and supports the first electrical component unit at the front surface side thereof, and the protrusion portion has a second electrical component unit support plate for supporting the second electrical component unit at the front surface side thereof and also supporting the sink tank at the rear surface side thereof, and a guide plate that is disposed substantially along the second electrical component unit support plate and forms a cooling air path for the sink tank in cooperation with the second electrical component unit support plate, the branch plate being provided between the guide plate and the first electrical component unit support plate.

According to the above construction, the branch plate is provided between the guide plate and the first electrical component unit support plate, and thus the branch plate serves as a resistor to the second cooling air directly flowing from the back surface of the machine chamber to the heat sink of the second electrical component unit. Therefore, the air flow amount of the second cooling air is reduced, and thus the air flow amount of the first cooling air flowing from the back surface of the machine chamber to the first electrical component unit is increased. Therefore, the electrical parts on the front surface of the first electrical component unit can be efficiently cooled.

In the above construction, the main body portion may be designed to be substantially U-shaped in top view, the protrusion portion may be designed to be substantially L-shaped in top view, and the electrical component box may be constructed by joining the main body portion and the protrusion portion to each other so that one side of the U-shaped main body portion bridges both the ends of the L-shaped protrusion portion in top view.

According to another aspect of the present invention, there is provided an outdoor unit having a housing that is vertically partitioned into a heat exchange chamber and a machine chamber by a partition plate, and an electrical component unit that is disposed on the upper portion of the partition plate so as to straddle the heat exchange chamber and the machine chamber and supports an electrical component board substantially in a horizontal position, wherein the electrical component unit has a frame member for supporting the electrical component board and a lid member that is joined to an upper portion of the frame member so as to cover the electrical component board from the upper side thereof, and the back surface of the lid member is provided with plural reinforcing ribs for enhancing mechanical strength of the lid member and the frame member when the lid member and the frame member are joined to each other, and a support rib for clamping the electrical component board in cooperation with the frame member when the lid member and the frame member are joined to each other.

According to the above outdoor unit, the electrical component unit has the frame member for supporting the electrical component board, and the lid member which is joined to the upper portion of the frame member and covers the electrical component board from the upper side. The back surface of the lid member is provided with the plural reinforcing ribs for enhancing the mechanical strength when the lid member and the frame member are joined to each other, and the support rib for clamping the electrical component board in cooperation with the frame member when the lid member and the frame member are joined to each other. Therefore, even when the case for supporting the electrical component board is designed in the frame shape, the situation that stress acts on the electrical component board due to an external load or external force can be suppressed.

In the above construction, the lid member may have a peripheral wall portion, the support rib may be provided along the peripheral wall portion of the lid member, and reinforcing ribs for enhancing mechanical strength of the lid member may be provided at a portion of the peripheral wall portion along which the support rib extends so that the reinforcing ribs are spaced from one another at predetermined intervals along the peripheral wall portion.

According to this construction, the area where the support rib of the lid member is provided can be concentrically reinforced to efficiently suppress the deformation of the support rib when external force acts, so that the stress on the electrical component board can be efficiently avoided.

Furthermore, in the above construction, the electrical component board may have a first half portion on which electrical parts are mounted and a second half portion on which heat generating parts for generating heat more than the electrical parts are mounted, the electrical parts and the heat generating parts may be mounted on the electrical component board so as to face the lower side of the frame member, a heat sink may be fixed to the frame member in close contact with the heat generating parts so as to project to the lower side of the frame member, the electrical parts may be disposed in the machine chamber and the heat sink may be disposed in the heat exchange chamber.

BRIEF DESCRIPTION OF THE DRAWINGS

Embodiments of the present invention will be described in detail based on the following figures, wherein.

DETAILED DESCRIPTION OF THE PREFERRED EMBODIMENTS

Preferred embodiments according to the present invention will be described hereunder with reference to the accompanying drawings.

An air conditioner according to the following embodiments comprises an outdoor unit 10 (110) and an indoor unit (not shown), and refrigerant is made to flow through a refrigerant circuit containing the indoor unit and the outdoor unit which are connected to each other through a refrigerant pipe, thereby performing cooling operation and heating operation. The outdoor unit 10 (110) is disposed outdoors, and heat-exchanges refrigerant with outside air heat so that the refrigerant is condensed under cooling operation to radiate heat to the outside air and also evaporated under heating operation to absorb heat from the outside air. The up-and-down direction and the right-and-left direction described below correspond to those directions which are defined when the set-up outdoor unit 10 (110) is viewed from the front side thereof.

<First Embodiment>

A first embodiment according to the present invention will be described with reference to FIGS. 1 to 5.

Figure 1:
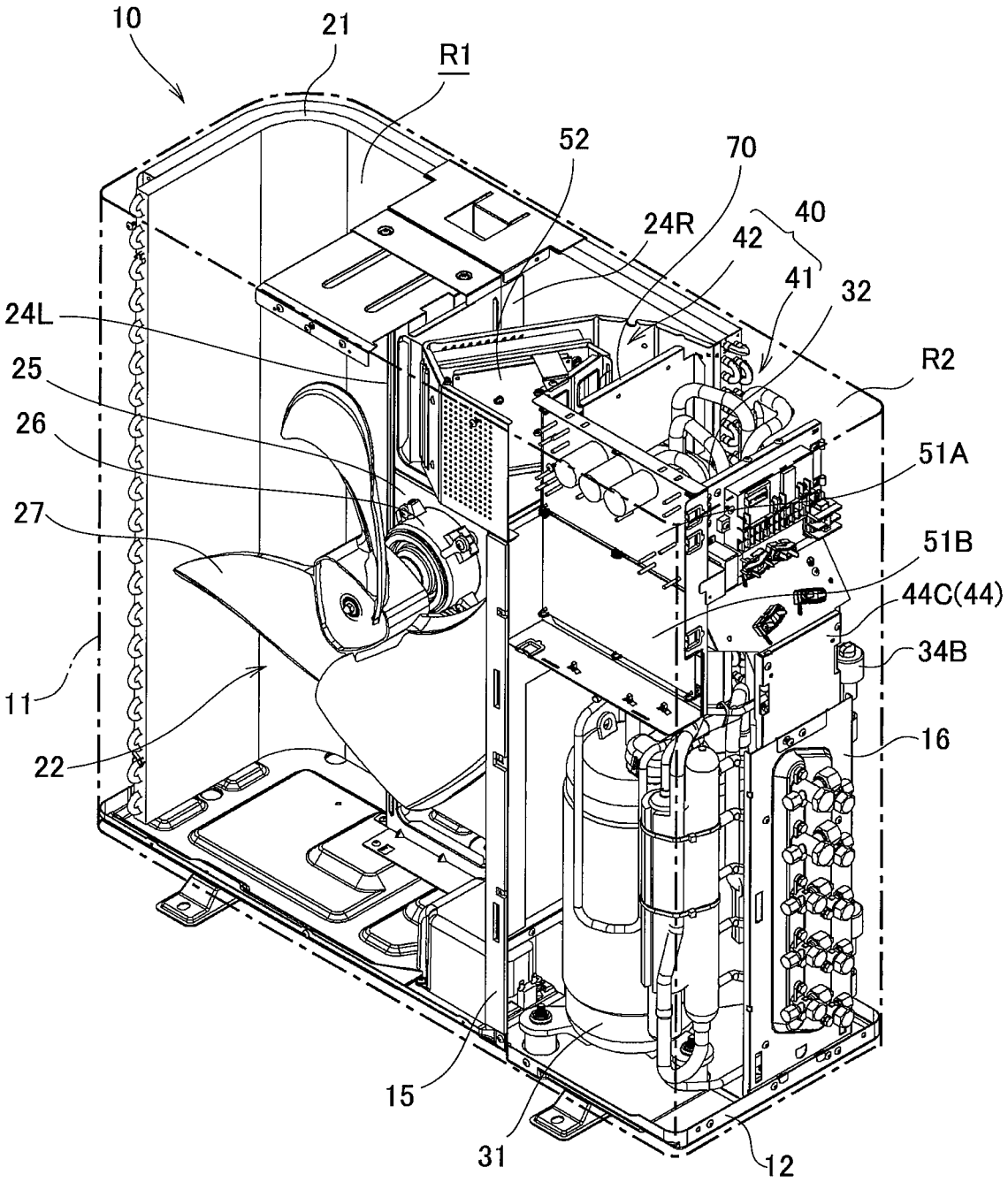
FIG. 1 is a perspective view showing an internal construction of an outdoor unit according to a first embodiment.
Figure 2:
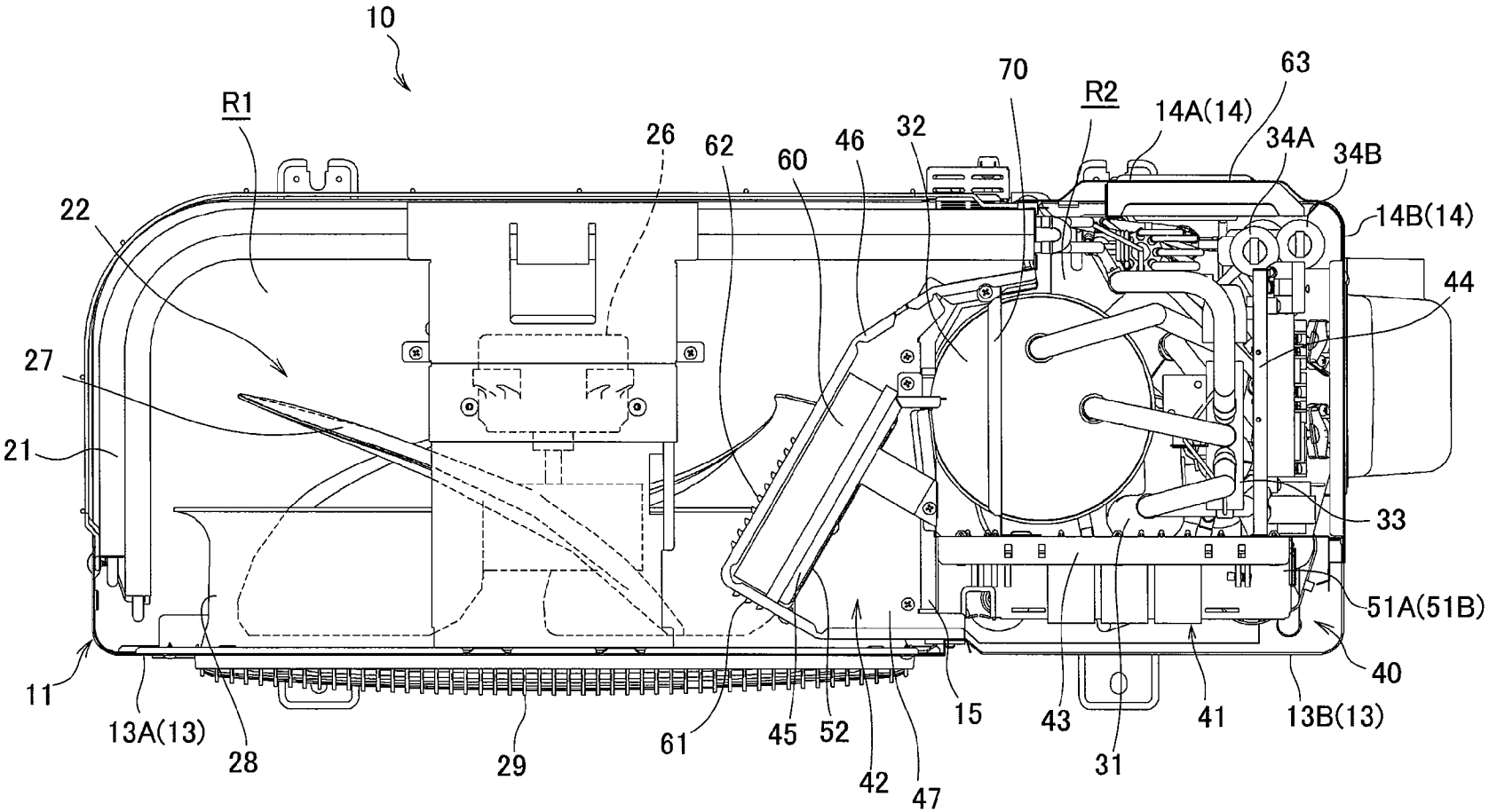
FIG. 2 is a diagram showing the outdoor unit when the outdoor unit is viewed from the top side.

FIG. 1 is a perspective view showing the internal construction of the outdoor unit 10, and FIG. 2 is a top view of the outdoor unit 10. The outdoor unit 10 has a substantially rectangular parallelepiped box-shaped unit case (housing) 11, and the unit case 11 has a bottom plate 12, a top plate (not shown), a front panel 13 (FIG. 2) and an outer plate 14 (FIG. 2). The inside of the unit case 11 is lengthwise (vertically) partitioned into a heat exchange chamber R1 and a machine chamber R2 by a partition plate 15 which extends from the bottom plate 12. In the example of FIG. 1, the top plate of the unit case 1, the front panel and the outer plate are represented by broken lines. As shown in FIG. 2, the front panel 13 comprises a first front panel 13A and a second front panel 13B which are separated from each other and disposed at the right and left sides with the partition plate 15 as the boundary thereof. By detaching each of the front panels 13A and 13B, a worker can easily perform a maintenance work of parts in the heat exchange chamber R1 and the machine chamber R2 from the front side.

As shown in FIG. 2, a heat exchanger 21 is mounted at the back side in the heat exchange chamber R1, and an air blower 22 is mounted at the front side in the heat exchange chamber R1. More specifically, the heat exchanger 21 is formed to be bent substantially in an L-shape in top view, and disposed so as to extend from the left side surface of the heat exchange chamber R1 along the back surface of the heat exchange chamber R1. The whole exposure surface from the left side surface to the back surface of the heat exchange chamber R1 is covered by a fin guard (not shown) formed of a net or the like which can prevent the contact of a human body or the like with the heat exchanger 21 while securing a ventilation path (air suction port). In this construction, the outer plate 14 is formed to be bent substantially in an L-shape in top view, thereby constituting a back surface portion 14A and a right side surface portion 14B of the unit case 11 intercommunicating with the heat exchanger 21.

As shown in FIG. 1, the air blower 22 comprises a fan motor 26 fixed to a pair of right and left support poles 24L and 24R in the heat exchange chamber R1 through a seat 25, and a propeller (axial fan) secured to the shaft of the fanmotor 26. The propeller fan 27 is disposed in proximity to the front surface side of the heat exchange chamber R1. Furthermore, as shown in FIG. 2, the front portion of the propeller fan 27 is put in a fan cover portion 28 designed in the form of a round flange, and the opening portion of the fan cover portion 28 functions as a ventilation path (air blow-out port). The opening portion is covered by a fan guard 29 for preventing the contact of a human body or the like with the propeller fan 27.

When the propeller fan 27 is rotated by the fan motor 26, outdoor air is sucked from the surrounding of the outdoor unit 10, more specifically from the back surface side and the left surface side of the heat exchanger 21 into the heat exchange chamber R1, passed through the substantially front surface of the heat exchanger 21, and then discharged through the fan cover portion 28 at the front side of the heat exchange chamber R1 to the outside. That is, the outdoor unit 10 is configured as a front-side blow-out type for blowing out heat-exchanged air from the front side to the outside.

Furthermore, refrigerant circuit constituent parts such as a compressor 31, an accumulator, valve members such as a four-way valve 33, expansion valves 34A and 34B, etc. are connected to one another through a pipe and mounted substantially at the lower space of the machine chamber R2. In this configuration, the accumulator 32 (FIG. 2) is provided at the upper side of the compressor 31. One end side of the pipe for the refrigerant circuit constituent parts is connected to the pipe of the indoor unit through the heat exchanger 21, and the other end side of the pipe for the refrigerant circuit constituent parts is connected to the indoor unit through a pipe, thereby constructing the refrigerant circuit in which refrigerant is circulated.

Furthermore, an electrical component box 40 in which various kinds of electrical component units such as a control board for controlling the air conditioner, etc. are accommodated is disposed at the upper space of the machine chamber R2.

Next, the electrical component box 40 will be described in detail.

Figure 3:
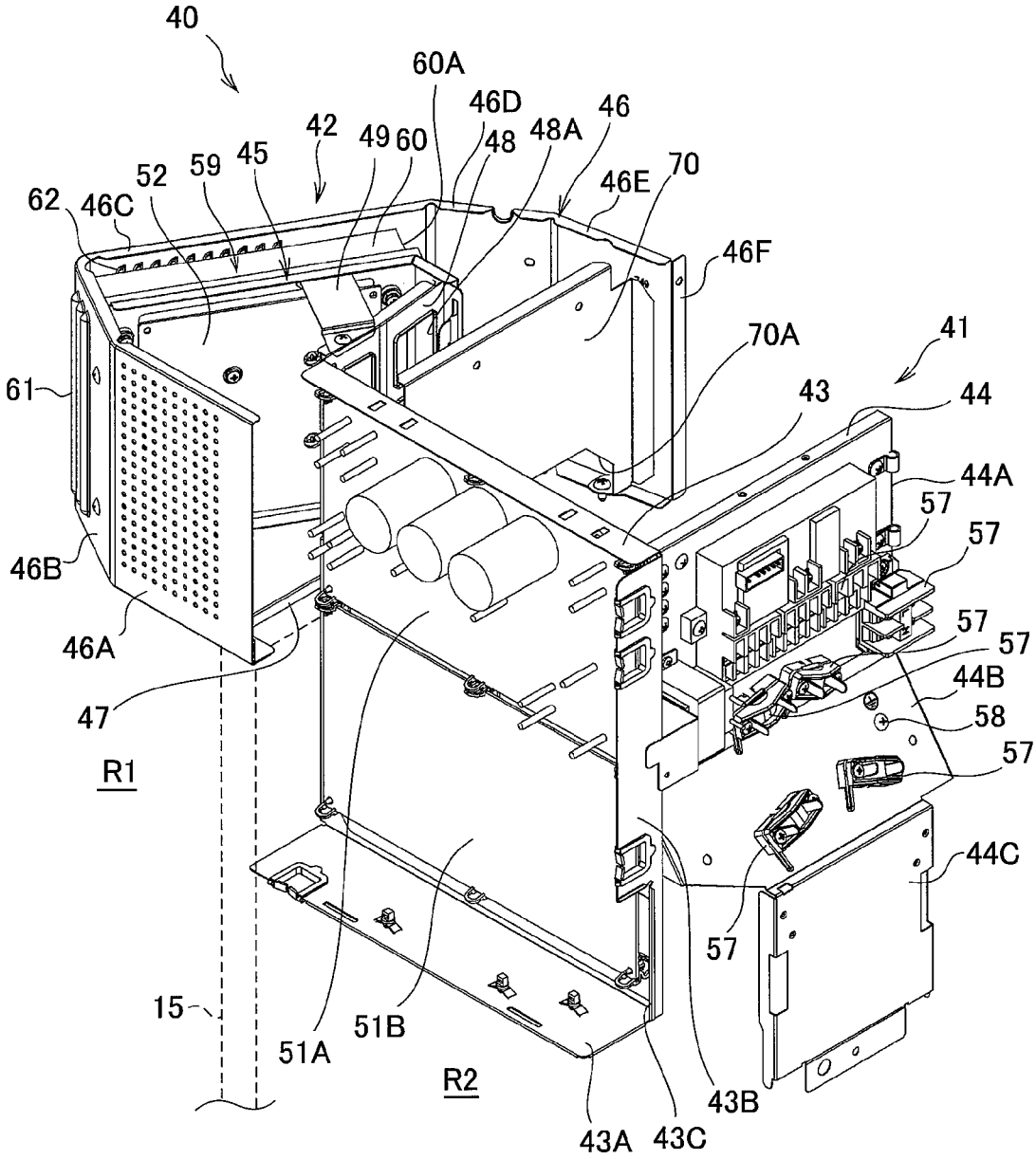
FIG. 3 is a perspective view showing an electrical component box and a peripheral construction thereof when the electrical component box is viewed substantially from the front surface side of the outdoor unit.
Figure 4:
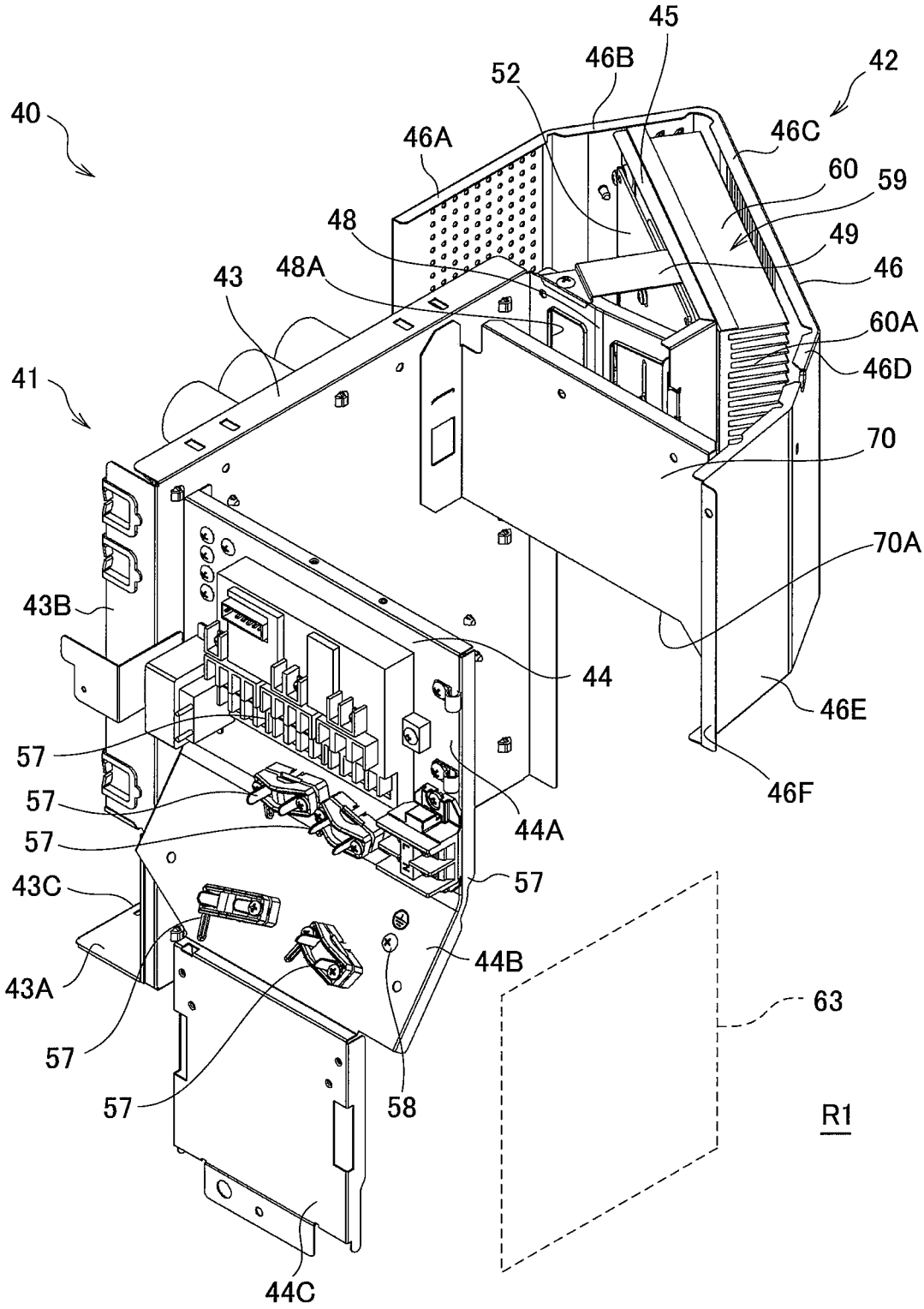
FIG. 4 is a perspective view showing the electrical component box when the electrical component box is viewed substantially from the back surface side of the outdoor unit.

FIG. 3 is a perspective view showing the electrical component box 40 and a peripheral construction thereof when they are viewed from the substantially front side of the outdoor unit 10, and FIG. 4 is a perspective view showing the electrical component box 40 when viewed from the substantially back side of the outdoor unit 10.

As shown in FIGS. 1 and 3, the electrical component box 40 is fixed on the partition plate 15, and has a main body portion 41 disposed in the machine chamber R2 and a protrusion (overhead) portion 42 which is formed so as to protrude from the machine chamber R2 to the heat exchange chamber R1 side. As shown in FIGS. 3 and 4, the main body portion 41 may be designed to be substantially U-shaped in top view and the protrusion portion 42 may be designed to be substantially L-shaped in top view. In this case, the electrical component box 40 is constructed by joining the main body portion 41 and the protrusion portion to each other so that one end side of the U-shaped main body portion 41 bridges both the ends of the L-shaped protrusion portion 42 (that is, the one end side of the U-shaped main body portion is sandwiched between both the ends of the L-shaped protrusion portion) in top view.

The main body portion 41 has a first electrical component unit support plate 43 provided at the front surface side of the machine chamber R2 so as to extend in the width direction of the machine chamber R2, and a terminal support plate 44 which is fixed to the right-side end portion side of the first electrical component unit support plate 43 and provided along the right side surface portion 14B of the outer plate 14. The first electrical component unit support plate 43 and the terminal support plate 44 are formed by subjecting a metal sheet to sheet metal processing such as bending processing or the like.

As shown in FIGS. 3 and 4, the terminal support plate 44 comprises three plate portions 44A, 44B and 44C which are constructed as a unified plate portion as if a sheet plate is bent and vertically sectionalized into three parts. Wiring connecting parts 57 such as a terminal base, etc. are disposed on the upper plate portion 44A, and an earth line connecting portion 58 for connecting a board earth line, a terminal earth line, etc. are disposed on the intermediate plate portion 44B. Furthermore, as shown in FIG. 1, the lower plate portion 44C is fixed to a service valve support plate 16 disposed at the right side surface portion 14B of the outer plate 14 as shown in FIG. 1.

As shown in FIG. 3, the first electrical unit support plate 43 is formed to have substantially the same width as the width of the machine chamber R2, and two first electrical component boards (first electrical component units) 51A and 51B are disposed in the up-and-down direction at the front surface side of the first electrical component unit support plate 43. Accordingly, by detaching the second front panel 13B, worker can easily access the first electrical component boards 51A and 51B, and also easily perform a maintenance work on the first electrical component boards 51A and 51B. Furthermore, in this construction, the lower end portion 63A and the right end potion 43B of the first electrical component unit support plate 43 are bent to the front side, and a cut-out 43C is formed at the lower portion of the right end portion 43B. The cut-out 43C forms a cooling air path through which cooing air flows in the machine chamber R2 to cool the first electrical component boards 51A and 51B.

As shown in FIGS. 3 and 4, the protrusion portion 42 has a second electrical component unit support plate 45 extending obliquely forwardly from the partition plate 15 to the heat exchange chamber R1 side, and a second electrical component board (second electrical component unit) 52 is disposed at the front surface side of the second electrical component unit support plate 45.

The second electrical component board 52 is a board on which various kinds of electrical component units for operating the respective parts of the air conditioner and controlling the operation of the respective parts, and electrical component parts having relatively large heating values such as an inverter circuit, etc. are actually mounted on the second electrical component board 52. That is, the second electrical component board 52 has a larger heating value than the first electrical component boards 51A and 51B. Therefore, a heat sink 60 is disposed in close contact with the back surface of the second electrical component unit support plate 45. The heat sink 60 is configured by arranging plural metal plates constituting fins in the up-and-down direction so that the metal plates are spaced from one another at predetermined intervals, and fixed to the second electrical component unit support plate 45 by screws or the like from the front side of the second electrical component unit.

Furthermore, the protrusion portion 42 has a guide plate 46 which surrounds the second electrical component unit support plate 45, the second electrical component board 52 and the heat sink 60 and forms a cooling air path 59 for the heat sink 60 in cooperation with the second electrical component unit support plate 45. The guide plate 46 is formed by subjecting one metal sheet to sheet metal processing such as bending processing or the like. The guide plate 46 has a front plate portion 46A, a first slant portion 46B, a second slant portion 46C, a third slant portion 46D, a back plate portion 46E and a tongue piece portion 46F. The front plate portion 46A is fixed to the partition plate 15, and the tongue piece portion 46F is fixed to the tube plate of the heat exchanger 21.

In this construction, the second slant portion 46C of the guide plate 46 is disposed substantially in parallel to the second electrical component unit support plate 45, and the first slant portion 46B intercommunicating with the second slant portion 46*c* is disposed at the exit side of the air path 59 for the heat sink 60. Ventilation ports 61 and 62 (see FIG. 3) through which cooling air passing through the heat sink 60 is blown out to the heat exchange chamber R1 are formed in the first slant portion 46B and the second slant potion 46C. These ventilation ports 61 and 62 are formed by cutting and erecting the first slant portion 46B and the second slant portion 46*c*, and cooling air passing through the heat sink 60 is blown out from the ventilation ports 61 and 62 to the negative pressure side of t air blower 22. In the protrusion portion 42, a bottom plate 47 is secured to the lower portion of the guide plate 46, and the inside of the protrusion portion 42 and the heat exchange chamber R1 are insulated from each other by the bottom plate 47. Accordingly, invasion of dust, rain drop, etc. from the heat exchange chamber R1 into the protrusion portion 42 is prevented.

Furthermore, a joint plate portion 48 for joining the first electrical component unit support plate 43 and the second electrical component unit support plate 45 to each other is provided on the partition plate 15, and an opening portion 48A through which cooling air passing over the front surfaces of the first electrical component boards 51A and 51B is led to the entrance of the heat sink 60 is formed in the joint plate portion 48. Furthermore, the joint plate portion 48 and the second electrical component unit support plate 45 are fixed to each other by a fixing piece 49.

As described above, the ventilation ports 61 and 62 formed in the protrusion portion 42 are formed so that air is blown out to the negative pressure side of the air blower 22 in the heat exchange chamber R1. Therefore, when the air blower 22 is operated, outside air is sucked into the machine chamber R2 through an air suction port 63 (FIG. 4) formed in the back surface of the machine chamber R2. This outside air cools the respective electrical component boards 51A and 51B and the heat sink 60 and then flows into the heat exchange chamber R1.

In this configuration, the electrical component box 40 has a branch plate 70 for branching the cooling air from the back surface of the machine chamber R2 into first cooling air for cooling the electrical parts on the front surfaces of the first electrical component boards 51A and 51B and second cooling air for cooling the heat sink 60 on the second electrical component board 52. Specifically, as shown in FIG. 3, the branch plate 70 is disposed through which the back plate portion 46E of the guide plate 46 and the first electrical component unit support plate 43 are connected to each other. A cut-out 70A is formed in the lower edge portion of the branch plate 70 so as to form a gap between the branch plate 70 and the upper surface of the accumulator 32.

By providing the branch plate 70 between the back plate portion 46E of the guide plate 46 and the first electrical component unit support plate 43, the branch plate 70 functions as a ventilation resistor for suppressing flow of the second cooling air from the air suction pot 63 to the entrance portion 60A of the heat sink 60.

Figure 5:
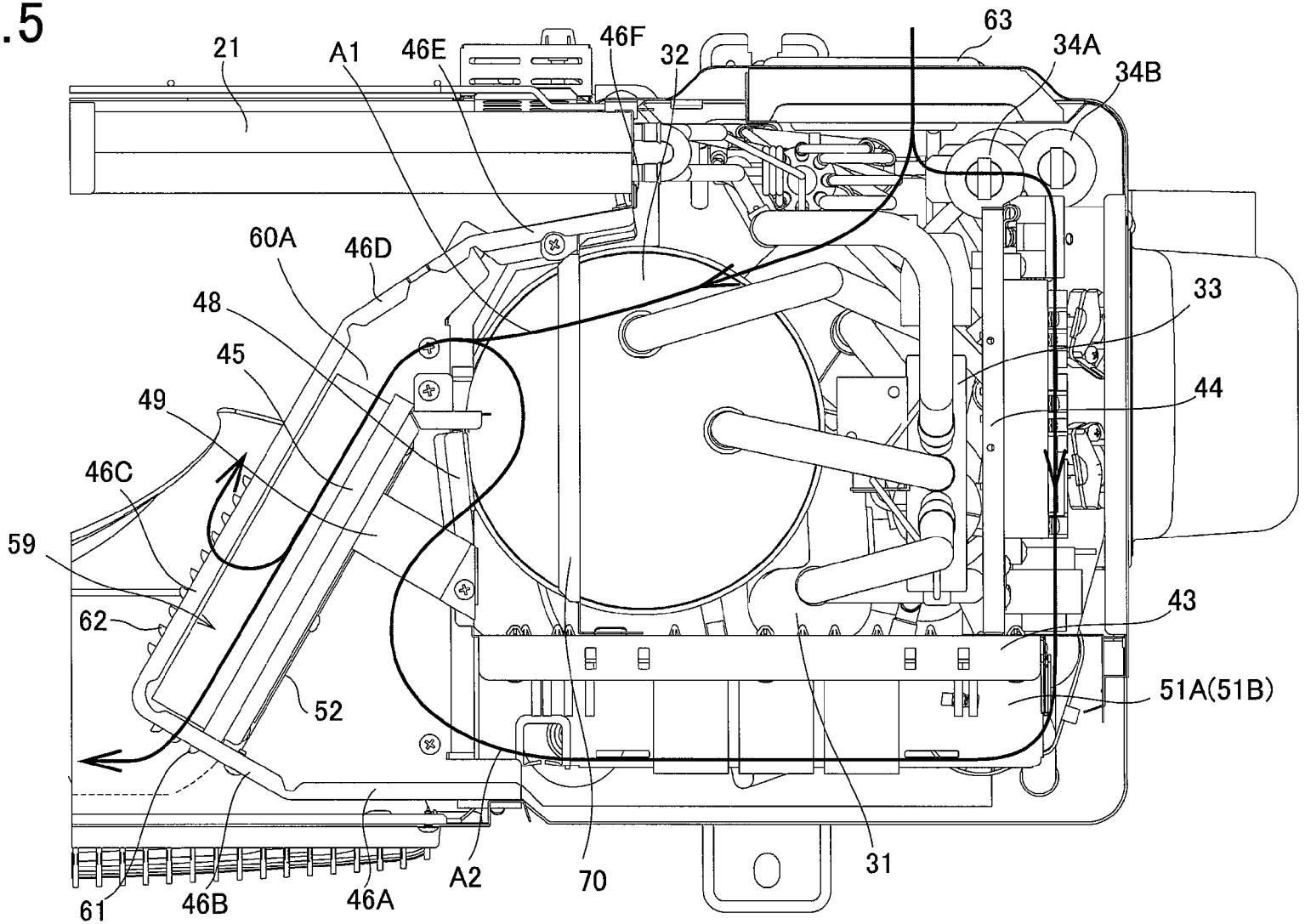
FIG. 5 is a plan view showing flow of cooling air in the electrical component box.

Therefore, a part of the outside air sucked from the air suction port 63 flows through the cut-out 70A to the entrance portion 60A of the heat sink 60 as indicated by a solid-line arrow A1 in FIG. 5. That is, in FIG. 5, the part of the outside air sucked from the air suction port 63 flows through the inside of the U-shaped main body portion 41 and through the cut-out 70A formed in one side (branch plate 70) of the U-shaped main body portion 41 in top view (a first air flow path). However, since the branch plate 70 functions as a resistor, the remaining outside air passes over the front surface of the first electrical component unit support plate 43 and through the opening portion 48A (FIG. 3) of the joint plate portion 48, and then flows to the entrance portion 60A of the heat sink 60 as indicated by a solid-line arrow A2 of FIG. 5, whereby the outside air is branched by the branch plate 70. That is, in FIG. 5, the remaining outside air sucked from the air suction port 63 flows so as to surround the three sides of the U-shaped main body portion 41, and then flows through one side (second slant portion 46C described later) of the L-shaped protrusion portion 42 to the heat exchange chamber (a second air flow path).

In this configuration, since the branch plate 70 serves as a resistor, the air amount of the second cooling air flowing to the entrance portion 60A of the heat sink 60 through the cut-out 70A is reduced. However, the air amount of the first cooling air flowing from the back surface of the machine chamber R2 to the first electrical component boards 51A and 51B is increased. Therefore, the electrical parts on the front surface of the first electrical component boards 51A and 51B can be efficiently cooled.

The first cooling air which has cooled the electrical parts on the front surfaces of the first electrical component boards 51A and 51B converges with the second cooling air passing through the cut-out 70A at the entrance portion 60A of the heat sink 60. Therefore, a sufficient air amount of cooing air flows to the heat sink 60 of the second electrical component board 52 due to confluence of the first cooling air and the second cooling air, and thus the heat sink 60 is sufficiently cooled. The cooling air flowing through the heat sink 60 passes through the ventilation ports 61 and 62 of the guide plate 46, flows to the negative pressure side of the air blower 22 in the heat exchange chamber R1, and then is discharged to the outside through the opening portion of the fan cover portion 28. Accordingly, the various kinds of parts in the machine chamber R2 can be cooled.

As described above, according to this embodiment, the electrical component box 40 has the main body portion 41 disposed in the machine chamber R2 and the protrusion portion (overhead portion) 42 protruding from the machine chamber R2 to the heat exchange chamber R1 side. The first electrical component boards 51A and 51*b* are arranged at the front surface side of the machine chamber R2 of the main body portion 41, and the second electrical component board 52 and the heat sink 60 on the second electrical component board 52 are arranged on the protrusion portion 42. Cooling air from the air suction port 63 formed in the back surface of the machine chamber R2 is branched into the first cooling air and the second cooling air so that the first cooling air is supplied to the first electrical component boards 51A and 51B. Therefore, the electrical parts on the front surfaces of the first electrical component boards 51A and 51B can be sufficiently cooled.

The first cooling air cools the electrical parts on the front surface of the first electrical component boards 51A and 51B, and then converges with the second cooling air for cooling the heat sink of the second electrical component unit, and thus a sufficient air amount of cooling air flows to the heat sink 60 of the second electrical component board 52, so that the heat sink 60 can be sufficiently cooled. Furthermore, the confluent cooling air cools the heat sink 60, and flows to the negative pressure side of the air blower 22 of the heat exchange chamber R1. Therefore, the cooling air can be made to smoothly flow into the heat exchange chamber R1, and thus sufficient amount of cooling air can be made to flow into the machine chamber R2 and the electrical component box 40.

Furthermore, according to this embodiment, the main body portion 41 has the first electrical component unit support plate 43 which extends in the width direction of the machine chamber R2 and supports the first electrical component boards 51A and 51B at the front surface side thereof, and the protrusion portion 42 has the second electrical component unit support plate 45 for supporting the second electrical component board 52 at the front surface side thereof and also supporting the heat sink 60 at the back surface side thereof, and the guide plate 46 having the second slant potion 46C which is disposed substantially along the second electrical component unit support plate 45 and forms the air flow path 59 of cooling air for the heat sink 60 in cooperation with the second electrical component unit support plate 45. Furthermore, the branch plate 70 is provided between the back plate portion 46E of the guide plate 46 and the first electrical component unit support plate 43, and thus the branch plate 70 functions as a resistor to the second cooling air flowing from the air suction port 63 formed in the back surface of the machine chamber R2 to the heat sink 60. Therefore, the air amount of the second cooling air is reduced. However, this reduction amount of the second air cooling conversely increases the air amount of the first cooling air flowing from the back surface of the machine chamber R2 to the first electrical component boards 51A and 51B, so that the electrical parts on the front surface of the first electrical component boards 51A and 51B can be efficiently cooled.

The present invention is not limited to the above-described embodiment, and various kinds of modifications and alterations may be made to the above-described embodiment. For example, the first electrical component boards 51A and 51B and the second electrical component board 52 disposed in the electrical component box 40 are not limited to the electrical component unit described above, and they may be properly changed Furthermore, the space at the back surface side of the first electrical component unit supporting plate 43 of the electrical component box 40 may be used as an arrangement space for other electrical component units or as an arrangement space for refrigerant circuit constituent parts such as pipes, etc., and the layout of various kinds of parts may be properly changed. Furthermore, the outdoor unit may be provided with not only one air blower 22, but also plural air blowers 22.

<Second Embodiment>

A second embodiment according to the present invention will be described with reference to FIGS. 6 to 12.

Figure 6:
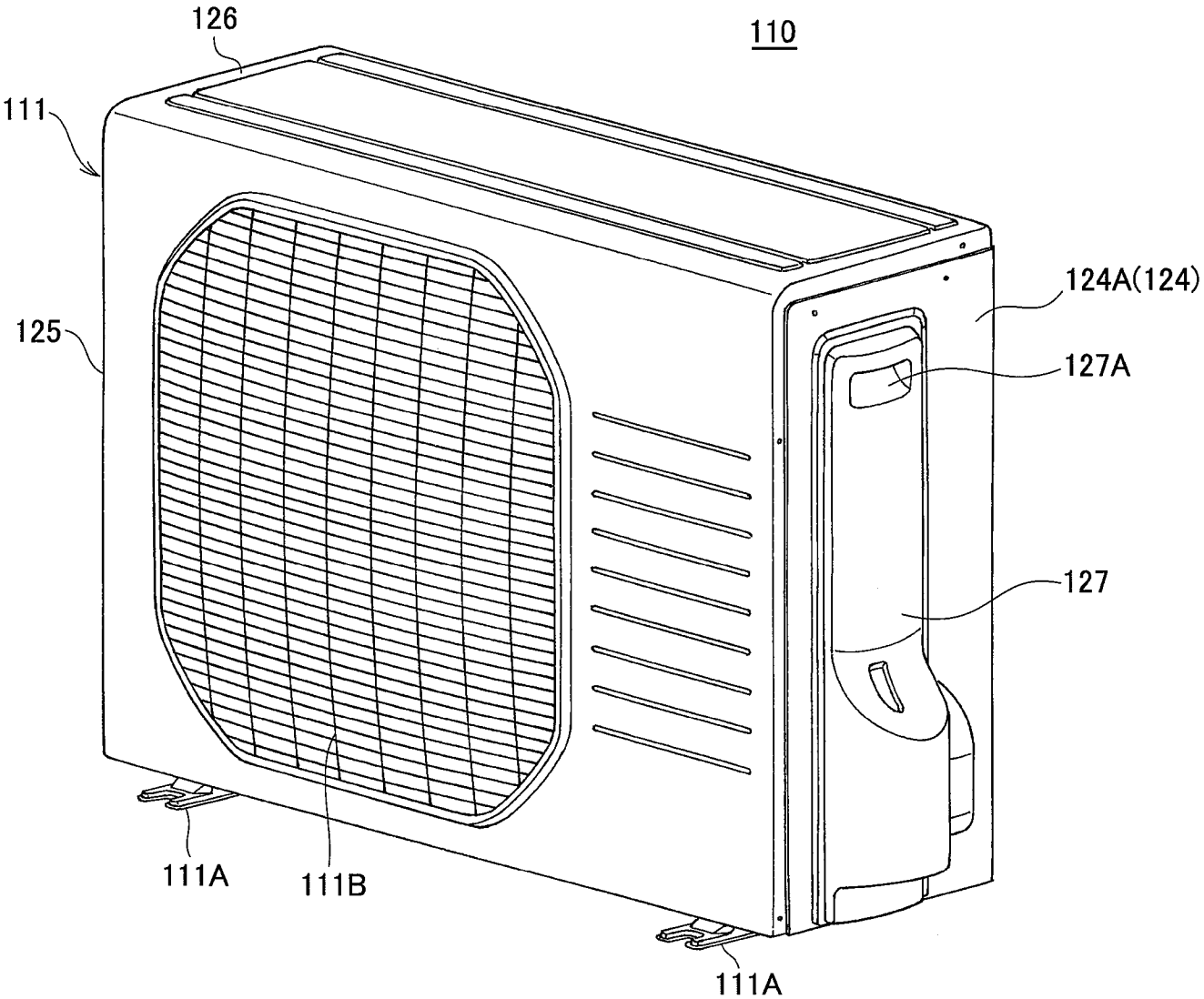
FIG. 6 is a diagram showing the outlook of an outdoor unit according to an air conditioner according to a second embodiment.

In FIG. 6, reference numeral 110 represents an outdoor unit of an air conditioner, and the outdoor unit 110 is disposed outdoors and has a substantially rectangular parallelepiped box-shaped housing 111.

The outdoor unit 110 is combined with an outdoor unit (not shown) to construct an air conditioner, and it is connected to the indoor unit through a refrigerant pipe to form a refrigeration cycle circuit. Refrigerant is made to flow through the refrigeration cycle circuit to heat-exchange with outside air, thereby air-conditioning (cooling or heating) a room. The up-and-down direction and the right-and-left direction described below are defined as directions viewed from the surface side of the outdoor unit 110 under the state that the outdoor unit 110 is set up.

Figure 7:
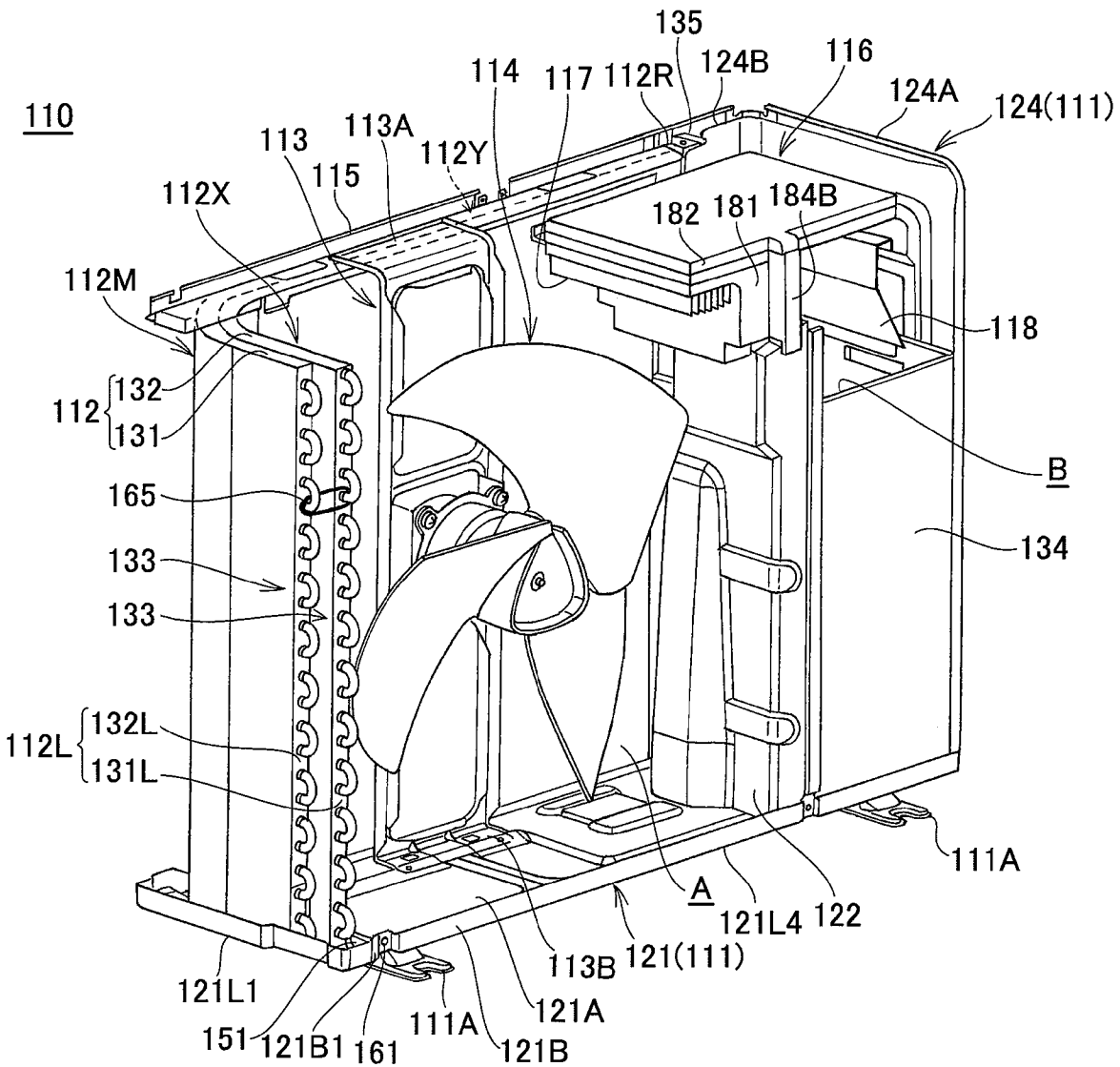
FIG. 7 is a perspective view showing the internal construction of the outdoor unit when the internal construction is viewed from a heat exchange chamber side.
Figure 8:
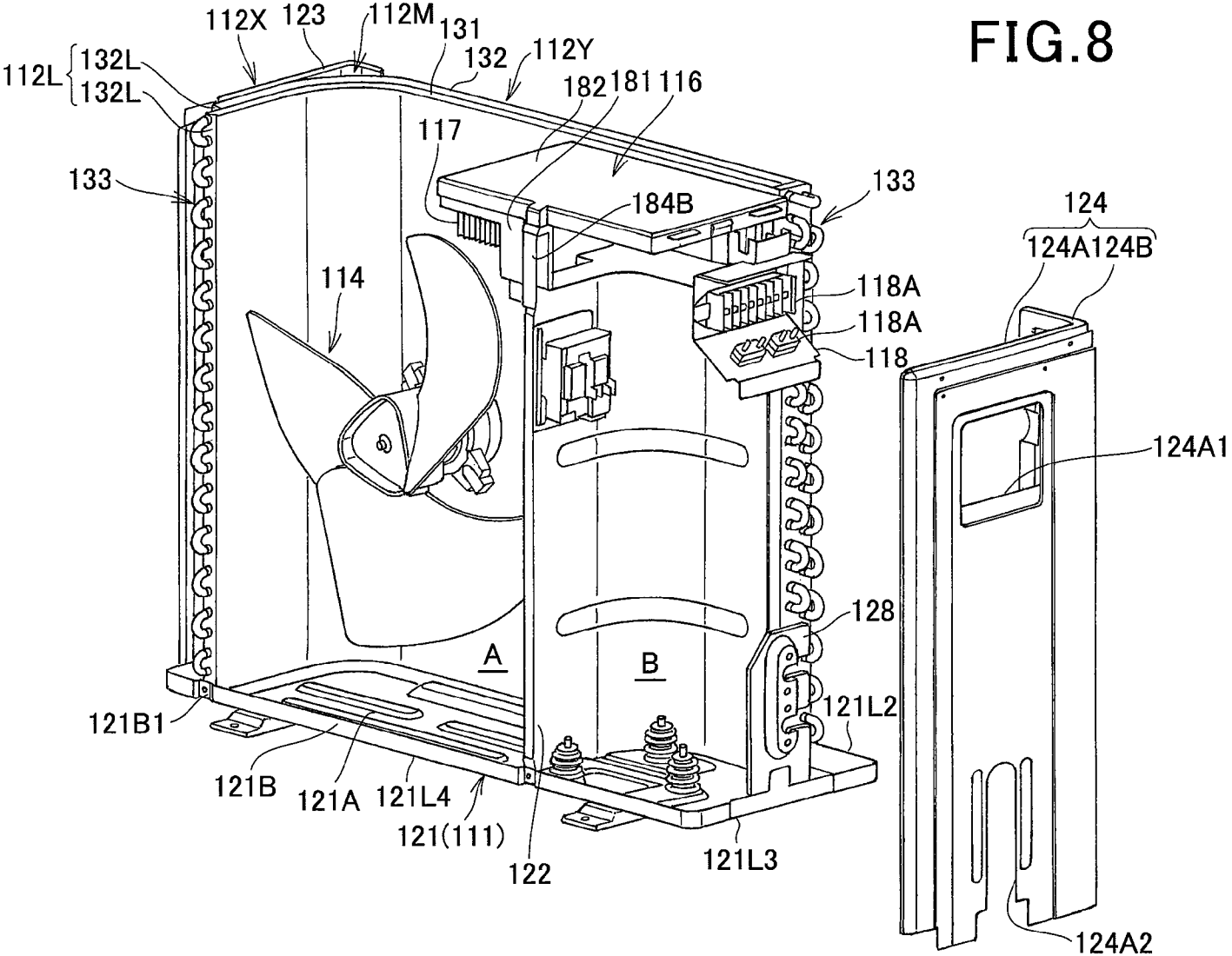
FIG. 8 is a perspective view showing the internal construction of the outdoor unit when the internal construction is viewed from a machine chamber side.
Figure 9:
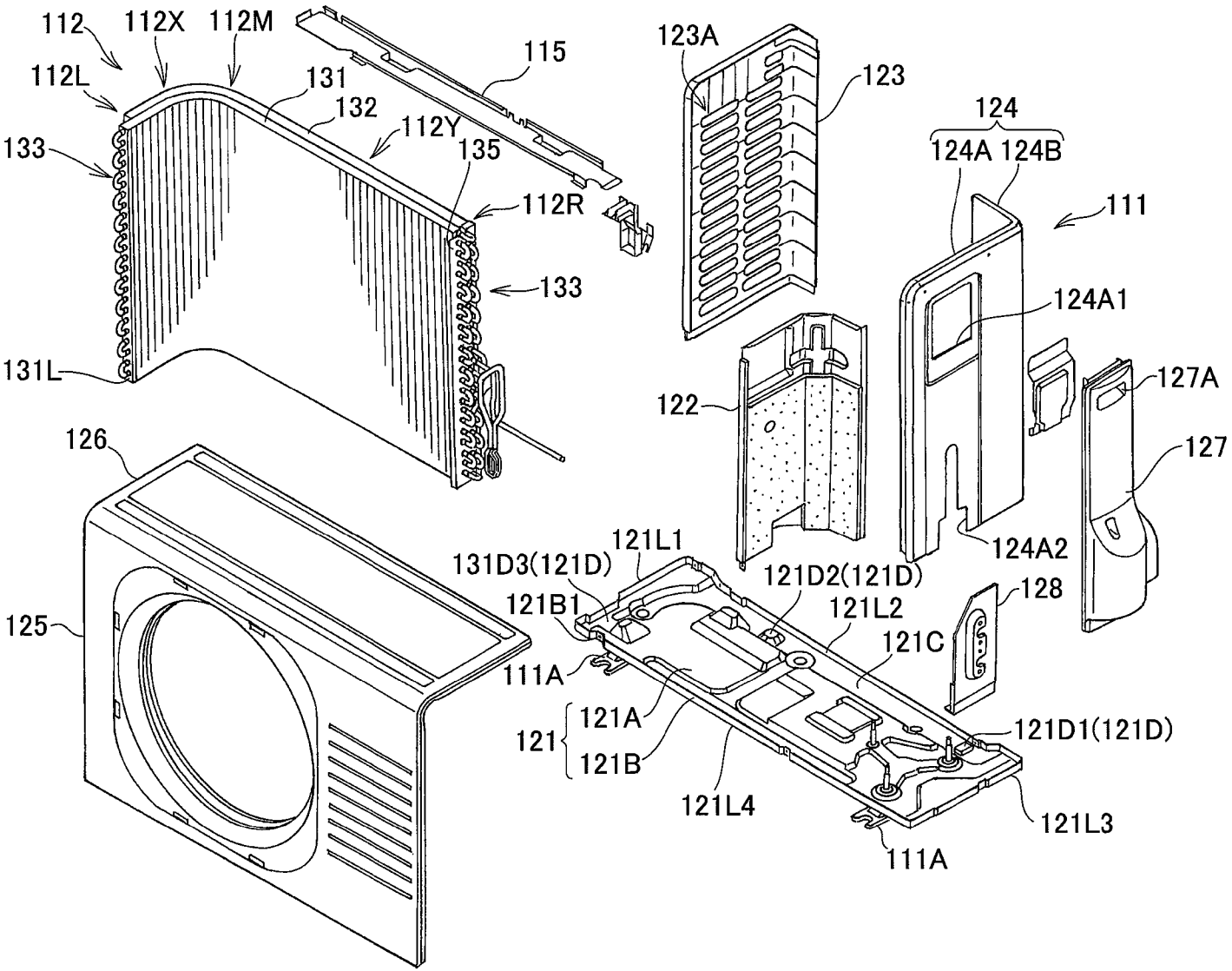
FIG. 9 is an exploded perspective view showing the housing of the outdoor unit and its peripheral construction.

FIGS. 7 and 8 are perspective views showing the internal construction of the outdoor unit 110, and FIG. 9 is an exploded perspective view showing the housing 111 of the outdoor unit 110 together with its peripheral construction.

As shown in FIGS. 7 and 8, in the outdoor unit 110, a partition plate 122 formed of a steel plate is erected from a bottom plate 121 of a steel plate constituting a part of the housing 111, and the inside of the housing 111 is partitioned into a heat exchange chamber A and a machine chamber B by the partition plate 122. The partition plate 122 is fixed to the bottom plate 121 by a fastening member such as a screw or the like.

An outdoor heat exchanger 112 which is designed to be L-shaped in top view and have a fixed width in the up-and-down direction is disposed in the heat exchange chamber A so as to extend along a short side 121L1 (see FIG. 9) at one side (left side) of the bottom plate 121 and a long side 121L2 (see FIG. 9) at the back surface side. Furthermore, an outdoor air blower 114 is disposed through a motor support table 113 (see FIG. 7) at the front surface side of the outdoor heat exchanger 112 in the heat exchange chamber A.

The motor support table 113 extends in the up-and-down direction at the front surface side of the outdoor heat exchanger 112, and supports the motor of the outdoor air blower 114 substantially at the center position in the up-and-down direction thereof. The motor support table 113 has planar flange portions 113A and 113B at the upper and lower ends thereof, and fixed to the housing 111 through the flange portions 113A and 113B.

More specifically, the flange portion at the upper end is designed to be substantially horizontally bent to the outdoor heat exchanger 112 located at the back surface side, and fixed to the upper surface of the outdoor heat exchanger 112 through an upper plate member 115 extending in the right-and-left direction of the outdoor unit 110 by a fastening member such as a screw or the like. Furthermore, the flange portion 113B at the lower end is designed to be substantially horizontally bent to the front surface side, and fixed to the bottom plate 121 by a fastening member such as a screw or the like. That is, the motor support table 113 is integrally joined to the outdoor heat exchanger 112 and fixed to the bottom plate 121, and it functions as a support member for supplying the outdoor heat exchanger 112 at the front surface side.

A compressor, an accumulator, a refrigerant pipe, etc. constituting a part of the refrigeration cycle circuit are disposed in the machine chamber B, and these machine parts such as the compressor, etc. are surrounded by a cover member 134 which is disposed in the machine chamber B and has noise barrier performance, etc.

An electrical component unit 116 in which a control board for controlling the air conditioner is mounted is disposed at the upper portion of the partition plate 122. The electrical component unit 116 is designed to be laterally long because it supports the control board in a horizontal position therein, and disposed so as to straddle the heat exchange chamber A and the machine chamber B in the housing 111.

That is, as shown in FIGS. 7 and 8, the partition plate 122 is formed to be lower than the upper surface of the outdoor heat exchanger 112, and the laterally long electrical component unit 116 is disposed at the upper portion of the partition plate 122, whereby the electrically component unit 116 is disposed so as to straddle the heat exchange chamber A and the machine chamber B substantially at the same height as the upper surface of the outdoor heat exchanger d112.

Since the electrical component unit 116 straddles the heat exchange chamber A and the machine chamber B as described above, the electrical component unit 116 functions as a part of the partition plate through which the heat exchange chamber A and the machine chamber B are insulated from each other, and also a large-scale electrical component board 180 described later can be accommodated in the electrical component unit 116. Furthermore, a heat sink 117 is provided at the heat exchange chamber A side of the electrical component unit 116, whereby heat of the electrical component board 180, etc. can be efficiently radiated to the outside by using air blowing of the outdoor air blower 114. As described later, the electrical component unit 116 has an electrical component case (frame member) 181 as a support frame for supporting the electrical component board 180, and a lid member 182 which is joined to the upper portion of the electrical component case 181 and covers the electrical component board 180 from the upper side thereof. Furthermore, the electrical component case 181 is provided with a guide wall 184B which is provided with a sponge-like seal member (not shown) for insulating the heat exchange chamber A and the machine chamber B from each other at the position of the electrical component case 181.

As shown in FIG. 9, the housing 111 of the outdoor unit 110 has one bottom plate 121 constituting the floor members of the heat exchange chamber A and the machine chamber B, right and left side plates 123 and 124 formed of steel plates which cover both the right and left sides of the heat exchange chamber A and the machine chamber B, a front plate 125 formed of a steel plate which covers the front surfaces of the heat exchange chamber A and the machine chamber B, and a top plate 126 formed of a steel plate which covers the upper portions of the heat exchange chamber A and the machine chamber B. The front plate 125 and the top plate 126 are formed integrally with each other, and designed to be substantially L-shaped in side view. In FIG. 6, reference numeral 111A represents a table for supporting the bottomplate 121 from the lower side thereof, and reference numeral 111B is a grille closing an opening for the air blower which is provided at the front plate 125.

The cover parts 121, 123 to 126 constituting the housing 111 are joined to one another by a fastening member such as a screw or the like. More specifically, the bottom plate 121 has a bottom plate portion 121A designed like a substantially horizontal plate, and a rising edge 121B (the side surface of the bottom plate 121) which is formed so as to be bent upwardly from the outer peripheral edge (the four sides 121L1 to 121L4) of the bottom plate portion 121A. The rising edge 121B extends along the four sides 121L1 to 121L4 of the bottom plate portion 121A, and are overlapped with the right and left side plates 123 and 124 and the front plate 125. Female screw holes are formed at this overlapped portion to be spaced from one another at predetermined intervals, and male screws (not shown) are fastened into the respective female screw holes from the outside of the right and left side plates 123 and 124 and the front plate 125, whereby the right and left side plates 123 and 124 and the front plate 125 are joined to one another.

Furthermore, with respect to other cover parts 123 to 126 other than the bottom plate 121, female screw holes are formed at inner parts of overlap potions between the other adjacent cover parts 123 to 126, and male screws (not shown) are fastened into the female screw holes from the outside under the overlap state, whereby the cover parts 123 to 126 are joined to one another.

No cover part is provided at the back surface side of the heat exchange chamber A in the housing 111, and thus the outdoor heat exchanger 112 disposed on the bottom plate 121 is exposed to the outside.

As shown in FIG. 9, many opening portions 123A are formed over the substantially whole surface of the side plate 123 at the heat exchange chamber A side, and outside air flowing in and out through the opening portions 123A is heat-exchanged with refrigerant in the outdoor heat exchanger 112 while a side of the outdoor heat exchanger 112 (a short side portion 112X described later) located at the inside of the side plate 123 is covered by the side plate 123.

Furthermore, the side plate 124 at the machine chamber B side has a side surface cover portion 124A for covering the side surface of the machine chamber B and a back surface cover portion 124B for covering the back surface of the machine chamber B, and the side surface cover portion 124A and the back surface cover portion 124B are formed integrally with each other so that the side plate 124 is designed to be L-shaped in top view. The back surface cover portion 124B extends so as to cover from the back surface side an end portion 112R at the machine chamber B side of the outdoor heat exchanger 112 (one end side of the refrigerant flow-in/flow-out sides of the outdoor heat exchanger 112) disposed on the bottom plate 121, and the outdoor heat exchanger 112 is joined to back surface cover portion 124B through a tube plate 135 fixed to the one end portion 112R of the outdoor heat exchanger 112.

The side surface cover portion 124A has a pair of upper and lower opening portions 124A1 and 124A2, and these opening portions 124A1 and 124A2 are covered by a cover plate 127 having a grip portion 127A.

Here, the upper opening portion 124A1 is an opening portion through which electrical part connecting portions (a terminal board, a connector portion) 118A (see FIG. 8) disposed on a base plate 118 joined to the electrical component unit 116 are exposed and wires from the external (the indoor unit or an external power source) is connected. The wires from the external penetrate through the cover plate 127 having the grip portion 127A. The lower opening portion 124A2 is an opening portion through which a pipe connecting portion to the refrigerant pipe in the machine chamber B is exposed and the refrigerant pipe is connected between the indoor unit and the outdoor unit. Here, in FIG. 9, reference numeral 128 represents a compact cover member secured to the pipe connecting portion side. A grip portion is also provided to a side plate 123 confronting to the side plate 124.

The outdoor heat exchanger 112 is a multi-array type heat exchanger having plural (two in this embodiment) fin tube type heat exchange portions 131 and 132 which are laminated in a thickness direction.

Each of the heat exchange portions 131 and 132 is a single array heat exchanger in which tubes extending substantially in the horizontal direction are vertically arranged in a tandem, and U-bent tubes 133 of steel tubes for connecting the upper and lower tubes at both the end portions of the horizontally extending tubes are also vertically arranged in a tandem. In the outdoor heat exchanger 112, a refrigerant entrance/exit port is provided to the end portion 112R of the machine chamber B side. An end portion 112L at the heat exchange chamber A side of the heat exchanger 112 serves as a refrigerant return portion which is provided at the end portion 112L to make refrigerant flowing in the tube flow to the end portion 112R side through the U-bent tube 133.

The outdoor heat exchanger 112 has an L-shape. The L-shaped outdoor heat exchanger 112 is constructed not by bending each of the heat exchange portions 131 and 132 in an L-shape and then superposing these heat exchange portions 131 and 132, but by superposing linearly-extending planar heat exchangers 131 and 132 in the thickness direction thereof, joining the heat exchange portions 131 and 132 to the same tube plate 135 while the one end portions 112R thereof serving as the refrigerant flow-in/flow-out side are aligned with each other and then the other end portions 112L thereof serving as the refrigerant return side are simultaneously bent under the state that the other end portions 112L are set as free ends.

Here, the other end portions 112L which are bent in an L-shape are set as free ends for the following reason. In the processing of bending the other end portions 112L in an L-shape, there occurs some difference in bending (curvature or curve length) between the bent portions 112M of the heat exchange portion 131 located outside and the heat exchange portion 132 located inside, and thus the end portions 112L of the respective heat exchange portions 131 and 132 are not aligned with each other at the same position. That is, at the end portion 112L of the outdoor heat exchange portion 112, the curvature of the inside heat exchanger portion 131 is smaller, and has a longer curve length. Therefore, a step portion is formed between the end portions 132L of the outside heat exchange portion 131 and the inside heat exchange portion 132.

The L-shaped outdoor heat exchanger 112 has a shorter linear portion extending from the bent portion 112M to the end portion 112L side, and a longer linear portion extending from the bent portion 112M to the end portion 112R side. Here, the end portion 112L side containing the shorter linear portion is represented by a short side portion 112X, and the end portion 112R side containing the longer linear portion is represented by a long side portion 112Y.

The outdoor heat exchanger 112 is mounted on the bottom plate 121 so that the short side portion 112X is placed along the short side 121L1 of the left side (heat exchange chamber side) of the bottom plate 121 and the long side portion 112Y is placed along the long side 121L2 of the back surface side of the bottom plate 121.

As shown in FIG. 9, a recess portion 121C is formed integrally with the bottom plate 121 so as to be downwardly recessed over a substantially L-shaped area in which the outdoor heat exchanger 112 is mounted, and a heat exchanger support table 121D is also formed integrally with the bottom plate 121 so as to support the outdoor heat exchanger 112 from the lower side at a position higher than the bottom surface of the recess portion 121C. Therefore, the outdoor heat exchanger 112 is mounted on the bottom plate 121 under the state that it is floated from the bottom surface of the recess portion 121C.

That is, the recess portion 121C is configured to function as a drain receiver for receiving drain from the outdoor heat exchanger 112, and quickly discharge the stocked drain through a drain discharge hole (not shown), a drain hose or the like to the outside.

Plural heat exchanger support tables 121D are provided, and they contain a first support table 121D1 for supporting the end potion 112R of the long side portion 112Y of the outdoor heat exchanger 112 from the lower side, a second support table 121D2 for supporting the substantially middle position between both the end portions 112R and 112L of the outdoor heat exchanger 112 from the lower side, and a third support table 121D3 for supporting the end portion 112L of the short side portion of the outdoor heat exchanger 112 from the lower side.

In the outdoor heat exchanger 112, one end potion 112R of the long side portion 112Y side is fixed to the side plate 124 at the machine chamber B side through a single tube plate 135, and also the other end portion 112L of the short side portion 112X side is fixed to the bottom plate 121 through a press member 151, whereby the outdoor heat exchanger 112 is stably fixed to the bottom plate 121.

More specifically, a projecting portion 121B which projects backwards to the end potion 131L side of the heat exchange portion 131 mounted on the bottom plate 121 is formed integrally with the rising edge 121B of the bottom plate 121, and the press member 151 is fixed to the projecting portion 121B1 by a fasting member such as a screw or the like. The press member 151 presses the end portion 131L of the heat exchange portion 131 located inwardly from the projecting portion 121B to the back surface side and the left side of the outdoor unit 110 to bring the inside and outside heat exchange portions 131 and 132 into close contact with each other, and also clamps the inside and outside heat exchange portions 131 and 132 between the press member 151 and the rising edge 121B of the bottom plate 121.

Figure 10A:
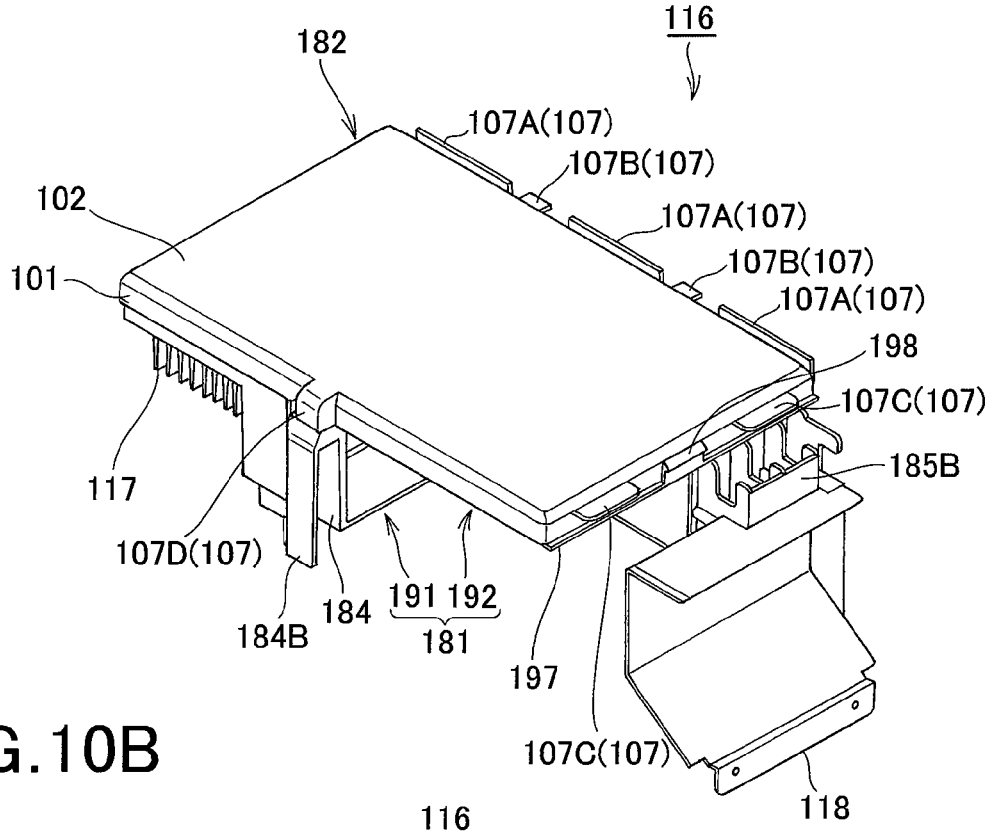
FIG. 10A is a diagram showing the outlook of an electrical component unit.
Figure 10B:
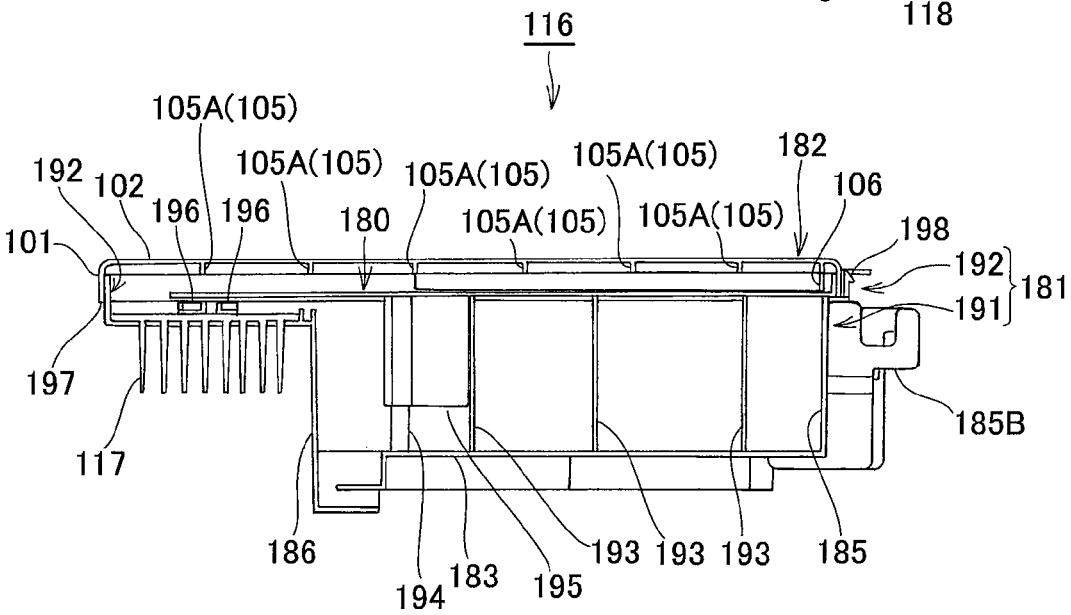
FIG. 10B is a side cross-sectional view of the electrical component unit.
Figure 11:
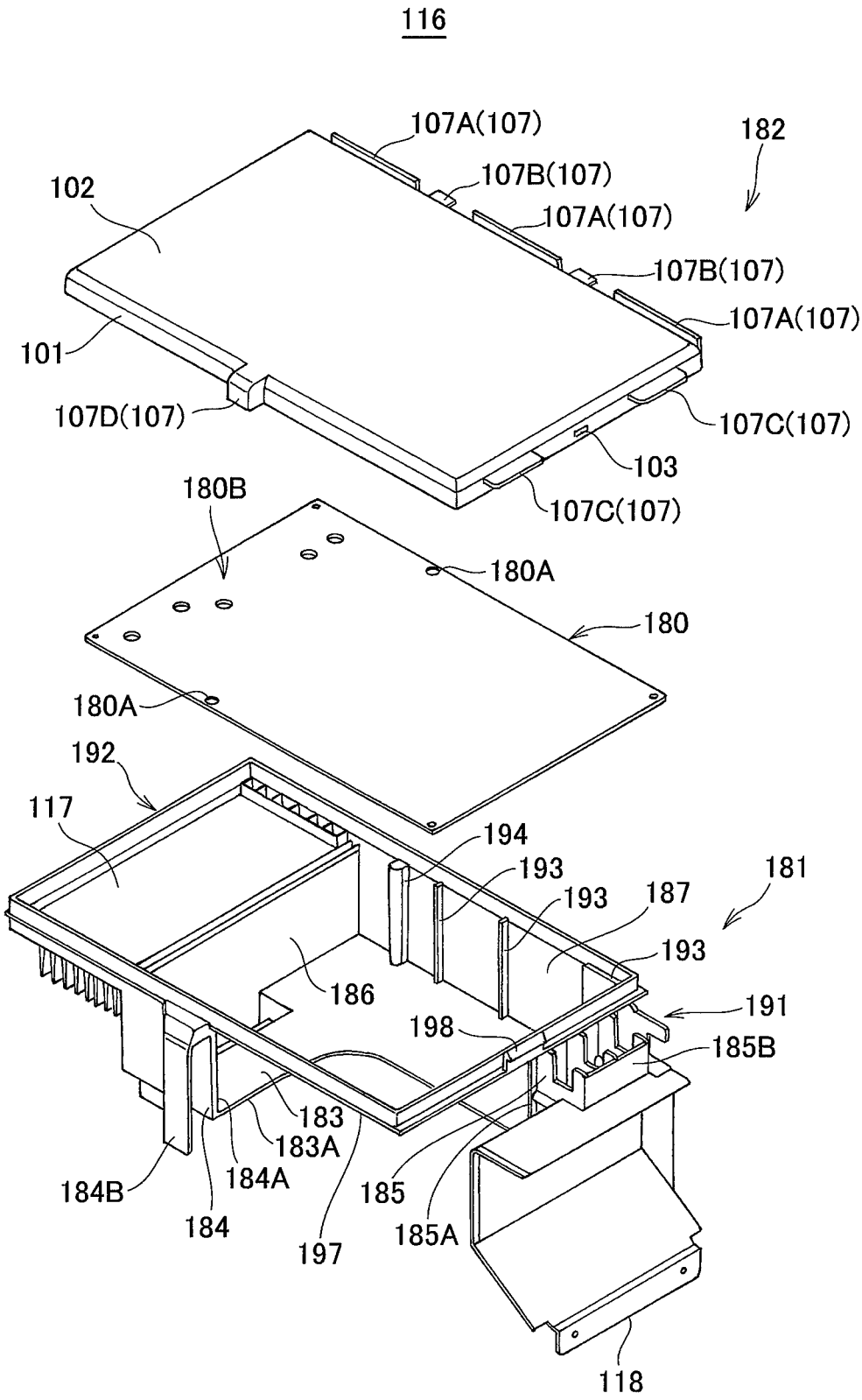
FIG. 11 is an exploded perspective view which is taken from an obliquely upper side of the electrical component unit.
Figure 12:
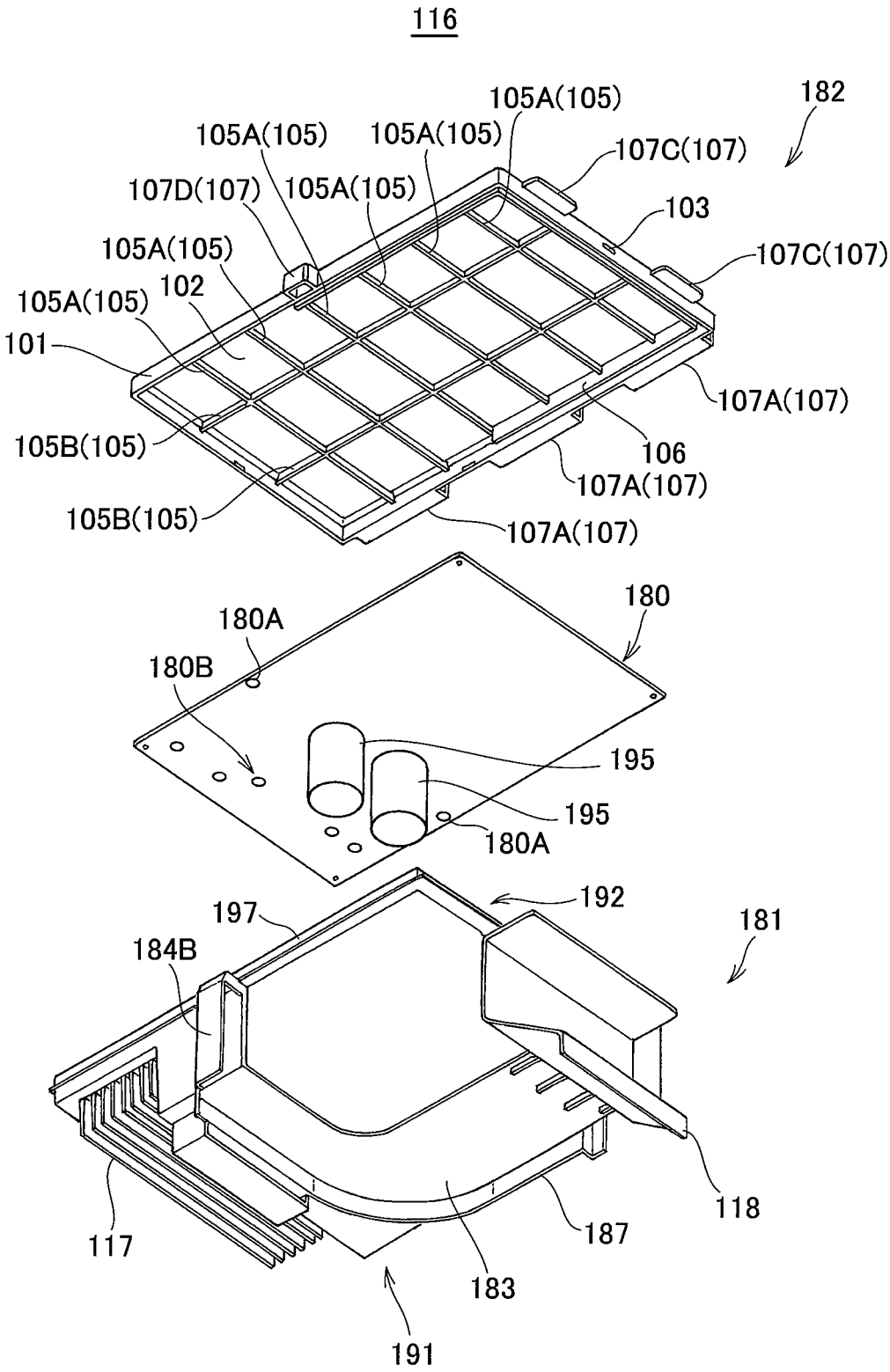
FIG. 12 is an exploded perspective view which is taken from an obliquely lower side of the electrical component unit.

Next, the electrical component unit 116 will be described. FIG. 10A is a diagram showing the outlook of the electrical component unit 116 and FIG. 10B is a side cross-sectional view of the electrical component unit 116. FIGS. 11 and 12 are exploded perspective views of the electrical component unit 116.

The electrical component unit 116 has an electrical component case (frame member) 181 as a support frame for supporting the electrical component board 180, and a lid member 182 which is joined to the upper portion of the electrical component case 181 and covers the electrical component board 180 from the upper side thereof, and these members are formed of synthetic resin.

The electrical component case 181 comprises a box portion 191 which has a bottom plate 183 and surrounding walls 184 to 187 and is provided at the machine chamber B side, and a board mount portion 192 which is provided at the upper portion of the box portion 191 over the machine chamber B and the heat exchange chamber A, and the box portion 191 and the board mount portion 192 are formed integrally with each other. The box portion 191 is designed in a box-shape so as to be opened in many directions containing the up-and-down direction, and also the board mount portion 192 is formed as a four-side frame surrounding the periphery of a board, that is, the board mount portion 192 is formed to have a frame shape.

More specifically, as shown in FIG. 11, a first opening portion 183A opened in the up-and-down direction at the right corner portion of the front surface of the outdoor unit 110 is provided in the bottom portion 183 of the box portion 191, a second opening portion 184A opened in the front-and-rear direction at the right side of the outdoor unit and a third opening portion 185A opened in the right-and-left direction at the front surface side of the outdoor unit.

That is, the opening portions 183A to 185A are formed in the box portion 191, thereby forming a large opening portion through which the right-side corner portion of the front surface of the outdoor unit is opened in the up-and-down direction, the front-and-rear direction and the right-and-left direction in the box portion 191. The large opening portion can secure ventilation in the box portion 191, reduce material and make it easy to access the machine chamber B, so that a maintenance work of the inside of the machine chamber B can be facilitated.

A resin fixing portion 185A for fixing a base plate 118 of a steel plate is provided to the right wall 185, and the base plate 118 is fixed to the fixing portion 185B.

The left wall 186 of the box portion 191 extends in the board mount portion 192 so as to insulate the heat exchange chamber A side and the machine chamber B side from each other, and functions as a reinforcing wall by joining the bottom plate 183, the front wall 184 and the rear wall 187 of the box portion 191 to one another to enhance the strength of the electrical component case 181.

Plural board receivers 193 for supporting the peripheral edge of the electrical component board 180 from the lower side are provided inside the board mount portion 192 so as to be integral with the board mount portion 192, and a pair of front and rear boss portions 194 having screw holes for fixing the electrical component board 180 are also provided inside the board mount portion 192 so as to be integral with the board mount portion 192. The board receivers 193 and the boss portions 194 extend inside the box portion 191 and function as inner reinforcing ribs for reinforcing the mechanical strength of the case 181.

A heat sink 117 is provided between the board mount portion 192 and the left wall 186 of the box portion 191. The heat sink 117 is fixed to the board mount portion 192 at the upper portion thereof, and has plural downward-facing fins which project downwardly. The heat sink 117 is disposed in the heat exchange chamber A.

Penetration holes 180A and penetration holes 180B are formed in the electrical component board 180. The electrical component board 180 is screwed and fixed to the boss portions 194 of the board mount portion 192 through the penetration holes 180A and also screwed and fixed to the heat sink 117 through the penetration holes 180B. As shown in FIG. 12, electrical parts 195 containing an electrolytic capacitor, etc. are mounted in a half portion of the electrical component board 180 at the machine chamber B side so as to greatly project from the electrical component board 180, and heat generating parts 196 (see FIG. 10B) containing a power module for an inverter and a bridge diode are mounted on the other half portion of the machine chamber B side at the heat exchange chamber A side. The electrical component board 180 is mounted in the board mount portion 192 with the electrical parts 195 and the heat generating parts 196 placed face down.

Here, the heat generating parts 196 are parts for generating heat more than the electrical parts 195 disposed at the half portion at the machine chamber B side, and these heat generating parts 196 are brought into close contact with the heat sink 117, so that the heat of these parts is efficiently radiated to the outside through the heat sink 117.

The outer peripheral portion of the board mount portion 192A is provided with a flange portion 197 against which the lower end of the peripheral wall portion 101 of the lid member 182 abuts, and also with a latch portion 198 to which the lid member 182 placed on the flange portion 197 is latched.

As described above, according to the electrical component unit 116 of this embodiment, the electrical parts 195 are mounted on one half portion of the electrical component board 180, the heat generating parts 196 which generate heat more than the electrical parts 195 are disposed on the other half portion of the electrical component board 180, the electrical parts 195 and the heat generating parts 196 are mounted to face the lower side of the electrical component case 181, the heat sink 117 which is brought into close contact with the heat generating parts 196 is secured to the electrical component case 181 so as to project downwardly, the electrical parts 195 are arranged in the machine chamber b and the heat sink 117 is disposed in the heat exchange chamber A. In this construction, the electrical component case 181 is required to be opened to the upper and lower sides, and also it is required to secure ventilation performance for the electrical parts 195 and the heat generating parts 196 which are mounted to face the lower side of the electrical component case 181.

As described above, the electrical component case 181 is designed to have the frame shape described above, so that the electrical component case 181 is opened in the up-and-down direction and also sufficient ventilation performance can be secured for the electrical parts 195, etc. However, the mechanical strength of the electrical component case 181 as a single body is lowered. On the other hand, when a steel plate is used to enhance the mechanical strength of the electrical component case 181, it is difficult to keep insulation performance of the electrical component unit 116 containing the electrical component unit 116 containing the electrical component case 181.

Therefore, according to this embodiment, the mechanical strength when the lid member 182 and the electrical component case 181 are jointed to each other is enhanced by the lid member 182, whereby the reduction in mechanical strength of the electrical component case 181 can be compensated and the sufficient mechanical strength can be secured for the overall electrical component unit 116.

Figure 13:
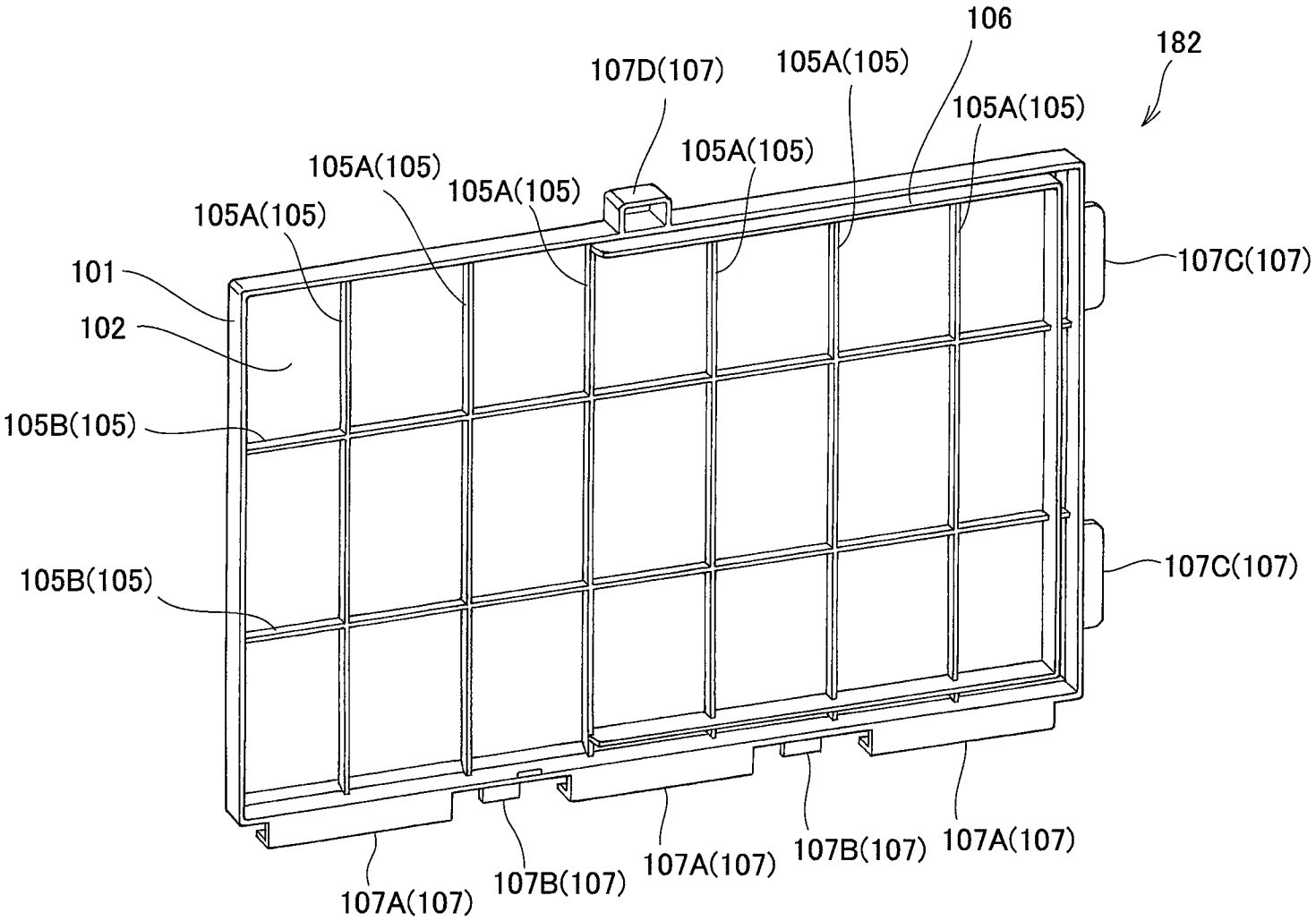
FIG. 13 is a diagram showing a lid portion viewed from the back side.

FIG. 13 is a back view of the lid member 182.

The lid member 182 is integrally formed by resin molding, and it has a peripheral wall portion 101 having a rectangular frame shape, and a top plate portion 102 extending between the upper ends of the peripheral wall portion 101.

The peripheral wall portion 101 is designed in a frame shape so as to be fitted in the board mount portion 192. When the lid member 182 is covered on the board mount portion 192, the inner surface of the peripheral wall portion 101 abuts against the outer peripheral surface of the board mount portion 192 as shown in FIG. 10B. When the lid member 192 is further pushed down, the lower end of the peripheral wall portion 101 abuts against the flange portion 197 of the board mount portion 192, and, at this time, a latch target portion 103 (see FIG. 11) provided to the peripheral wall portion 101 is latched to the latch portion 198 provided to the board mount portion 192, thereby preventing the lid member 182 from falling off.

That is, the lid member 182 is covered on the board mount portion 192 of the electrical component case 181 from the outside thereof and joined to the electrical component case 181, and also at this joint time the lid member 182 is engagedly fitted to the board mount portion 192, whereby the joint strength between the electrical component case 181 and the lid member 182 is enhanced.

The upper surface of the top plate portion 102 of the lid member 182 is formed as a flat face, and thus even when the top plate 126 of the outdoor unit 110 or the like comes into contact with the lid member 182, no bruise occurs on the top plate 126 or the like.

Plural reinforcing ribs 105 and a support rib 106 for pressing the electrical component board 180 from the upper side are integrally formed on the back surface (lower surface) of the top plate portion 102 of the lid member 182.

The reinforcing ribs 105 are constructed by plural longitudinal ribs 105A and plural lateral ribs 105 which extend in a grid form on the back surface of the top plate portion 102. Each of the longitudinal ribs 105A and the lateral ribs 105B extends between the confronting peripheral wall portions 101 of the lid member 182, thereby enhancing the mechanical strength of the whole lid member 182.

If the mechanical strength of the lid member 182 is enhanced, the lid member 182 would function as a reinforcing member when it is joined to the electrical component case 181, and thus the reduction of the mechanical strength which is caused by the formation of the large opening portion in the electrical component case 181 can be compensated. That is, the sufficient mechanical strength can be secured for the electrical component unit 116 constructed by joining the lid member 182 and the electrical component case 181.

The support rib 106 is formed so as to project more downwardly as compared with the reinforcing ribs 105. Therefore, when the lid member 182 is joined to the electrical component case 181, the electrical component board 180 is pressed from the upper side by the support rib 106, and the electrical component board 180 is clamped by the support rib 106 and the plural board receivers 193 and the boss portions 194 provided at the board mount portion 192 side. That is, the support rib 106 clamps the electrical component board 180 in cooperation with the electrical component case 181 when the lid member 182 and the electrical component case 181 are joined to each other.

This support rib 106 is provided along the peripheral wall portion 101 of the lid member 182. More specifically, it is provided along three side portions at the machine chamber B side of the peripheral wall portion 101 (i.e., the right side of the front wall, the right wall and the right side of the rear wall) and extends in an U-shape in bottom view, whereby the support rib 106 efficiently presses the right half portion of the electrical component board 180. Furthermore, the support rib 106 is joined to each reinforcing rib 105 so as to mutually enhance the mechanical strength of the other rib. Accordingly, the mechanical strength of the electrical component unit 116 constructed by joining the lid member 182 and the electrical component case 181 to each other can be enhanced.

As shown in FIG. 13, outside reinforcing ribs (other reinforcing ribs) 107 for enhancing the mechanical strength of the lid member 182 are provided to at least a portion of the peripheral wall portion 101 of the lid member 182 along which the support rib 106 extends so that they are spaced from one another at predetermined intervals. The outside reinforcing ribs 107 extend along the peripheral wall portion 101, concentrically reinforce an areas where the support rib 106 of the lid member 182 is provided, and efficiently suppress deformation of the support rib 106 when external force acts, so that the stress on the electrical component board 180 can be efficiently avoided.

Here, the outside reinforcing ribs 107 of this embodiment have not only the reinforcing function, but also another function. More specifically, with respect to the reinforcing ribs 107A and 107B provided at the rear side of the lid member 182, wires which are drawn in the neighborhood of the lid member 182 (for example, wires connected to the outdoor air blower 114) are supported from the lower side by the ribs 107A and also pressed from the upper side by the ribs 107B.

Furthermore, the reinforcing ribs 107C provided at the right side of the lid member 182 protrudes more outwardly as compared with the flange portion 197 of the electrically component case 181 as shown in FIG. 10, whereby the reinforcing ribs 107*c* function as grip tabs which a worker grips when the lid member 182 is attached or detached by the worker.

Still furthermore, the outside reinforcing rib 107D provided at the front surface side of the lid member 182 is connected to the guide wall 184B on which a sponge-like seal member (not shown) through which the heat exchange chamber A and the machine chamber B are insulated from each other at the locating position of the electrical component case 181.

The guide wall 184B is integrally provided to the front wall 184 of the electrical component case 181, and extends upwardly at the partition (insulation) position of the heat exchange chamber A and the machine chamber B. Therefore, the sponge-like seal member is disposed over the whole area from the guide wall 184B to the outside reinforcing rib 107D connected to the guide wall 184B, whereby the gap between the electrical component unit 116 and the front plate 125 of the outdoor unit 125 can be easily closed at the partition position of the heat exchange chamber A and the machine chamber B.

That is, in this embodiment, the electrical component case 181 as the frame member is provided with the guide wall 184B which extends upwardly along the front plate 125 of the outdoor unit 110 between the heat exchange chamber A and the machine chamber B, and the peripheral wall portion 101 of the lid member 182 is provided with the outside reinforcing rib 107D intercommunicating with the guide wall 184B, whereby the mechanical strength of the electrical component unit 116 can be enhanced and also the work of securing the seal member can be facilitated.

As described above, according to this embodiment, the back surface of the lid member 182 is provided with the plural reinforcing ribs 105 for enhancing the mechanical strength of the electrical component case 181 when the lid member 182 and the electrical component case 181 are joined to each other, and the support rib 106 which clamps the electrical component board 80 in cooperation with the electrical component case 181 when the lid member 182 and the electrical component case 181 are joined to each other. Therefore, even when the electrical component case 181 for supporting the electrical component board 180 is formed as a frame member of resin, the sufficient mechanical strength can be secured for the electrical component unit 116 constructed by joining the lid member 182 and the electrical component case 181. Accordingly, such a situation that stress is applied to the electrical component board 180 by an external load (external force), and the electrical component board 180 can be properly supported.

Particularly, according to this construction, the mechanical strength of the lid member 182 constituting the upper portion of the electrical component unit 116 is enhanced, and thus even when external force acts on the electrical component unit 116 below the top plate 126 through the top plate 126 of the outdoor unit 110, the electrical component unit 116 can be efficiently avoided from being deformed. Furthermore, the reinforcing ribs 105 are provided to the back surface of the lid member 182, so that the top plate portion 102 of the lid member 182 can be made as a flat face, and thus the top plate 126 can be avoided from being bruised. In addition, the lid member 182 is formed of resin, and thus the insulation of the electrical component unit 116 can be easily kept.

The present invention is not limited to the above embodiments, and various kinds of modifications and alterations may be made without departing from the subject matter of the present invention. For example, in the above embodiment, the present invention is applied to the outdoor unit in which the electrical parts 195 and the heat generating parts 196 are mounted on the electrical component board 180 so as to face the lower side of the electrical component case 181, the electrical parts 195 are disposed in the machine chamber B, and the heat sink 117 for radiating the heat of the heat generating parts 196 is disposed in the heat exchange chamber A while secured to the electrical component case 181. However, the present invention is not limited to this embodiment, and may be broadly applied to any outdoor unit having an electrical component unit comprising a frame-shaped electrical component case and a lid member.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the skilled in the art to understand the invention for various embodiments and with the various modifications as are suited to the particular use contemplated. It is intended that the scope of the invention be defined by the following claims and their equivalents.

What is claimed is:

1. An outdoor unit comprising:

a housing that is vertically partitioned into a heat exchange chamber and a machine chamber by a partition plate;

a heat exchanger and an air blower that are mounted in the heat exchanger chamber; and a compressor and an electrical component box that are mounted in the machine chamber, wherein:

the electrical component box comprises:

a main body portion that is disposed in the machine chamber and has a first electrical component unit containing electrical parts at a front surface side of the machine chamber; and a protrusion portion that protrudes from the machine chamber into the heat exchange chamber and has a second electrical component unit containing a heat sink, the main body portion and the protrusion portion are joined to each other so as to form an air flowing path for sucking cooling air from a back surface side of the machine chamber, branching the cooling air into first cooling air and second cooling air so that the second cooing air directly flows to an entrance of the heat sink of the second electrical component unit to cool the heat sink and the first cooling air passes over the electrical parts of the first electrical component unit to cool the electrical parts and then converges with the first cooling air at the entrance of the heat sink, and then discharging the first cooling air and the second cooling air to a negative pressure side of the air blower in the heat exchange chamber, the main body portion has a first electrical component unit support plate that extends in a width direction of the machine chamber and supports the first electrical component unit at a front surface side thereof, the protrusion portion has a second electrical component unit support plate for supporting the second electrical component unit at a front surface side thereof and also supporting the heat sink at a rear surface side thereof, and the second electrical component unit support plate is disposed separately, without touching the first electrical component unit support plate, and a space is formed between the first and second electrical component unit support plates, so that the first cooling air flows through the space to the heat sink at the rear surface side.

2. The outdoor unit according to claim 1, wherein the electrical component box has a branch plate for branching the cooling air sucked from the back surface side of the machine chamber into the first cooling air and the second cooling air.

3. The outdoor unit according to claim 2, wherein the protrusion portion has a guide plate that is disposed substantially along the second electrical component unit support plate and forms a cooling air path for the heat sink in cooperation with the second electrical component unit support plate, the branch plate being provided between the guide plate and the first electrical component unit support plate.

4. The outdoor unit according to claim 1, wherein:

the main body portion is designed to be substantially U-shaped in top view, the protrusion portion is designed to be substantially L-shaped in top view, and the electrical component box is constructed by joining the main body portion and the protrusion portion to each other so that one side of the U-shaped main body portion bridges both the ends of the L-shaped protrusion portion in top view.

5. The outdoor unit according to claim 1, wherein:

a joint plate portion connected to the first electrical component unit support plate and the second electrical component unit support plate is provided on the partition plate, and an opening portion through which cooling air passing over front surfaces of the first electrical component unit is led to the entrance of the heat sink is formed in the joint plate portion.

* * * * *